US010763060B2

(12) United States Patent
Gery et al.

(10) Patent No.: US 10,763,060 B2
(45) **Date of Patent: *Sep. 1, 2020**

(54) MECHANICAL CUT-OFF APPARATUS FOR A HIGH-VOLTAGE OR VERY HIGH-VOLTAGE ELECTRIC CIRCUIT WITH SPLITTING DEVICE

(71) Applicant: SUPERGRID INSTITUTE, Villeurbanne (FR)

(72) Inventors: Maxime Gery, Felines (FR); Paul Vinson, Charvieu (FR)

(73) Assignee: SUPERGRID INSTITUTE, Villeurbanne (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,252

(22) Filed: Jul. 10, 2019

(65) Prior Publication Data

US 2019/0355534 A1 Nov. 21, 2019

Related U.S. Application Data

(63) Continuation of application No. 15/750,848, filed as application No. PCT/FR2016/051958 on Jul. 28, 2016, now Pat. No. 10,354,819.

(30) Foreign Application Priority Data

Aug. 7, 2015 (FR) ..... 15 57622

(51) Int. Cl.
*H01H 33/08* (2006.01)
*H01H 33/12* (2006.01)
(Continued)

(52) U.S. Cl.
CPC ..... *H01H 33/12* (2013.01); *H01H 33/08* (2013.01); *H01H 33/14* (2013.01); *H01H 33/56* (2013.01); *H01H 2235/01* (2013.01)

(58) Field of Classification Search
CPC ..... H01H 9/36; H01H 33/12; H01H 33/08; H01H 33/14; H01H 33/56; H01H 33/04; H01H 33/10; H01H 33/164
(Continued)

(56) References Cited

U.S. PATENT DOCUMENTS 3,128,360 A * 4/1964 Rietz ..... H01H 33/75 218/105
3,185,797 A 5/1965 Porter
(Continued)

FOREIGN PATENT DOCUMENTS

CH 543170 A 10/1973
DE 19910119 A1 9/2000
(Continued)

*Primary Examiner* — Edwin A. Leon
*Assistant Examiner* — William A Bolton
(74) *Attorney, Agent, or Firm* — Workman Nydegger

(57) ABSTRACT

A mechanical breaker apparatus for breaking an electric circuit comprises two electrodes that are movable relative to each other, and including an electric arc splitter device having a multitude of distinct conductive elements that are spaced apart and electrically insulated relative to one another. The splitter device has a first portion and a second portion that are movable relative to each other between: an electrical contact position; and a spaced-apart position of the two portions. The splitter device has at least one series of the distinct conductive elements that, in an electrically closed position of the electrodes of the mechanical apparatus, are arranged along the continuous electrically-conductive path for the nominal electric current through the apparatus as defined by the two portions of the splitter device in the electrical contact position.

25 Claims, 12 Drawing Sheets

(51) Int. Cl.
*H01H 33/14* (2006.01)
*H01H 33/56* (2006.01)

(58) Field of Classification Search
USPC .... 218/12–18, 34, 38, 45, 46, 55, 68, 78–81
See application file for complete search history.

(56) References Cited

U.S. PATENT DOCUMENTS

| | | | | | |
|---|---|---|---|---|---|
| 3,201,552 | A | | 8/1965 | Baldini | |
| 3,288,969 | A | | 11/1966 | Reece | |
| 3,361,885 | A | * | 1/1968 | McConnell | H01H 33/75 218/103 |
| 3,392,249 | A | | 7/1968 | McCloud et al. | |
| 3,524,958 | A | | 8/1970 | Frink | |
| 3,646,296 | A | * | 2/1972 | Hess | H01H 33/75 218/103 |
| 3,819,893 | A | | 6/1974 | Jawelak et al. | |
| 3,872,272 | A | | 3/1975 | Yoshioka | |
| 4,048,457 | A | * | 9/1977 | Tragesser | H01H 33/75 218/105 |
| 4,458,121 | A | | 7/1984 | Yanabu et al. | |
| 5,616,898 | A | | 4/1997 | Maineult | |
| 9,543,086 | B2 | | 1/2017 | Ermel et al. | |

FOREIGN PATENT DOCUMENTS

| | | | |
|---|---|---|---|
| EP | 2876659 | A1 | 5/2015 |
| FR | 2662300 | A1 | 11/1991 |
| JP | S52103369 | U | 8/1977 |

* cited by examiner

MECHANICAL CUT-OFF APPARATUS FOR A HIGH-VOLTAGE OR VERY HIGH-VOLTAGE ELECTRIC CIRCUIT WITH SPLITTING DEVICE

FIELD

The disclosure relates to the technological field of breaker apparatuses for high voltage electric circuits.

BACKGROUND

In conventional manner, electricity networks on the scale of a region, of a country, or of a continent, in which electric currents are transported over several tens, hundreds, or thousands of kilometers, are high voltage alternating current (AC) networks. Nowadays, trends in such networks are towards interconnecting infrastructures so as to obtain networks that are meshed, i.e. networks having a plurality of available paths between any two given points of the network. Furthermore, proposals have been made to develop networks or network portions using very high voltage direct current (DC), possibly integrated within meshed networks, together with portions of AC networks.

One of the problems in meshed networks lies in the possibility of transferring load currents between the different branches of the network in order to reorganize power flows, with this requiring electric circuits under high voltage to be opened or closed. This problem is even more acute with DC circuits. A conventional approach would be to use circuit breakers as breaker apparatuses, given that they are designed in particular to make it possible to open an electric circuit under load in which they are interposed. Nevertheless, circuit breakers are apparatuses that are complex, expensive, and voluminous, and they are intended for network protection functions, and would be under-used in such circumstances. In order to perform such load transfer functions, it may be helpful to use apparatuses of simpler design, such as disconnectors, even though those apparatuses are not primarily designed to break circuits that are under load. In the usual way in order to provide safety for equipment and personnel during interventions, disconnectors are to be found at each end of a line. It is thus appropriate to extract maximum benefit from those apparatuses.

In particular for high voltage circuits, it is also known to use so-called "metal-clad" apparatuses in which active breaker members are enclosed in a sealed enclosure filled with an insulating fluid. Such a fluid may be a gas, commonly sulfur hexafluoride ($SF_6$), but it is also possible to use liquids or oils. The fluid is selected for its insulating character, in particular so as to present dielectric strength that is greater than that of dry air at equivalent pressure. Metal-clad apparatuses may be designed in particular so as to be more compact than apparatuses in which breaking and insulation are provided using air.

A conventional disconnector comprises in particular two electrodes that are held by insulating supports in stationary positions that are spaced apart from the peripheral wall of an enclosure, which wall is at ground potential. The electrodes are connected together electrically or separated electrically as a function of the position of a movable connection member forming part of one of the electrodes, e.g. a sliding tube actuated by a control. The tube is generally carried by one electrode, to which it is electrically connected, and separating the tube from the opposite electrode is likely to create an electric arc that may lengthen during the opening movement of the disconnector, while the tube is moving away from the opposite electrode. Conventionally, the disconnector has two pairs of electrical contacts carried by the tube and the two electrodes. The first pair is the pair that passes the nominal current in the fully closed position of the apparatus. This path for passing current, referred to as the "nominal path", presents a path of least electrical resistance, thereby reducing conduction losses under steady conditions. This pair of contacts is associated with a second pair referred to as "arcing" contacts or as the secondary contact pair. The two contacts in this pair are caused to remain in close contact while the first pair is separated so as to avoid any arcing phenomenon on the first pair and thereby guarantee a good state of electrical conduction in the fully closed position. Conversely, the contacts of the secondary pair separate later on and an electric arc is struck between them. They need to be able to withstand such wear. Once the electric arc becomes long enough, and after a sufficient length of time, the electric arc becomes interrupted.

A disconnector is generally situated in an electricity substation. It is connected to the other elements of the substation, e.g. by busbars. On either side of a disconnector, other elements of the substation may be found such as a circuit breaker, a power transformer, an overhead bushing, . . . .

Such a disconnector without any specific device for facilitating breaking could be used to transfer those currents, and it would be capable of accommodating smaller stresses, but it would be inappropriate for circuits that present large loop impedances.

Under such circumstances, opening can lead to electric arcs that may stretch to considerable lengths, and that can lead to various problems. An arc that is too long between the connection member and the opposite electrode can degenerate and turn into a short circuit. For example, in a disconnector of the above-described type, an arc might strike between the live electrode and the wall of the enclosure connected to ground. In a less extreme situation, arc extinction times can become too long and can damage component parts and thus endanger the insulation of the system.

In certain circuit breakers designed to operate with AC at medium voltage, an arc splitter chamber is provided that is separate from the zone in which the movable connection member moves and that is offset away therefrom. An electric arc that forms, e.g. during opening of the circuit, is split into a multiplicity of arcs. Such circuit breakers require means to be provided for causing the arc to move away from the zone in which the movable member moves and towards the splitter chamber, e.g. by using a magnetic field, which may be created by permanent magnets or which may be induced by current flowing in a magnetic circuit. Either way, this aspect is complex to manage and requires numerous round trips during design stages in order to ensure that the arc goes into the splitter chamber, since the way the system behaves varies as a function of the magnitudes of the currents being switched. Furthermore, the splitter chamber constitutes additional bulk. For a metal-clad apparatus, this volume also needs to be insulated from the tank at ground potential in order to guarantee electrical insulation. This can lead to tanks of large size and costs that are disadvantageous.

SUMMARY

There therefore remains a need to create apparatus for breaking high voltage circuits that is compact and capable of opening a circuit that is passing its nominal load current, and to do so under conditions that do not affect either the safety or the lifetime of the apparatus, while taking account in particular of regulatory constraints.

To this end, the disclosure provides mechanical breaker apparatus for a high voltage or very high voltage electric circuit, the apparatus being of the type comprising two electrodes that are to be connected electrically respectively to an upstream portion and to a downstream portion of the electric circuit, the two electrodes of the mechanical apparatus being movable relative to each other in an opening movement between at least one electrically open position and at least one electrically closed position in which they make a nominal electrical connection of the apparatus, said nominal electrical connection serving to pass a nominal electric current through the apparatus, and the apparatus being of the type including an electric arc splitter device having a multitude of distinct conductive elements that, for at least one active state of the splitter device, are spaced apart and electrically insulated from one another so as to define, in a surrounding insulating fluid, a multitude of successive distinct individual free paths in which electric arcs can be struck on opening and/or closing the electric circuit.

According to embodiments of the disclosure, the apparatus is characterized in that the splitter device comprises a first portion and a second portion, at least one of which is movable relative to the other with a relative spacing movement between:

at least one electrical contact position of the two portions defining a continuous electrically-conductive path for the nominal electric current through the apparatus; and at least one spaced-apart position of the two portions;

and in that the splitter device includes at least one series of distinct conductive elements that are arranged along the continuous electrically-conductive path as defined by the two portions of the splitter device in the electrical contact position for passing the nominal electric current through the apparatus.

According to embodiments of the disclosure, which may be combined with the features but which may also be independent therefrom, the above-defined apparatus is characterized in that the splitter device comprises a first portion and a second portion, at least one of which is movable relative to the other with a relative spacing movement between:

at least one electrical contact position of the two portions; and at least one spaced-apart position of the two portions;

in that one of the two relatively movable portions of the splitter device includes an elongate contactor, the contactor being electrically connected, at least during a stage of breaking the contact, with one of the portions of the electric circuit, and the other of the two relatively movable portions of the splitter device includes an insulating body having arranged thereon said series of distinct conductive elements; and in that the contactor and the series of distinct conductive elements are arranged respectively in such a manner that in the electric contact position of the two portions, the distinct conductive elements are arranged on the insulating body in succession along the elongate contactor.

In a third aspect of the disclosure, which may be combined with the first but which is independent therefrom, the above-defined apparatus is characterized in that the splitter device comprises a first portion and a second portion, at least one of which is movable relative to the other with a relative spacing movement between:

at least one electrical contact position of the two portions; and at least one spaced-apart position of the two portions;

in that each of the two relatively movable portions of the splitter device includes an insulating body having arranged thereon a series of distinct conductive elements that are electrically insulated from one another; and in that the two series of distinct conductive elements are arranged respectively in such a manner that:

in the electrical contact relative position of the two portions, each distinct conductive element of the two series, with the exception of end elements, is electrically in contact with two successive distinct conductive elements of the other series; and in at least one spaced-apart relative position, and in any spaced-apart relative position of the two portions distinct from the electrical contact relative position of the two portions, each distinct conductive element of the two series may be spaced apart from distinct conductive elements of the other series.

According to optional characteristics of embodiments of the disclosure, taken singly or in combination, and in association with any of the aspects of embodiments of the disclosure:

in the electrically closed position of the electrodes of the mechanical apparatus, the nominal electric current flows along a main continuous electrically-conductive path, and the continuous electrically-conductive path for the nominal electric current defined by the two portions of the splitter device in the electrical contact position constitutes a secondary continuous electrically-conductive path through the apparatus, along which said distinct conductive elements are arranged;

in the electrically closed position of the electrodes of the mechanical apparatus, the nominal electric current flows along the continuous electrically-conductive path for the nominal electric current defined by the two portions of the splitter device in the contact position, which constitutes a main continuous electrically-conductive path through the apparatus along which said distinct conductive elements are arranged;

at least one of the portions of the splitter device includes said series of distinct conductive elements arranged along the continuous electrically-conductive path;

for said spaced-apart position of its two portions, the splitter device defines a desired electrical path between the upstream portion and the downstream portion of the electric circuit, which desired electrical path comprises in alternation conductive sections comprising the distinct conductive elements, and insulating sections comprising the successive distinct individual free paths;

for said spaced-apart position, the sum of the lengths of the distinct individual free paths of the desired electrical path is greater than the length of the spacing movement of the two portions between their contact position and said spaced-apart position;

in their contact position, the two portions of the splitter device are in electrical contact via a multitude of distinct electrical contacts, each of which involves at least one of the distinct conductive elements; and the relative spacing movement of the two portions is controlled by the opening movement of the electrodes of the apparatus between their extreme open and closed positions.

According to optional characteristics of the disclosure, taken singly or in combination, and in association with other embodiments of the disclosure:

that in the extreme spaced-apart position, the contactor is spaced apart from the distinct conductive elements;

the contactor is elongate along a helical curve; and the insulating body on which the series of distinct conductive elements is arranged forms a channel in which the contactor extends in the contact position, the channel being released of the contactor at least in part in spaced-apart or intermediate positions so as to form a preferred electric arc path between two successive distinct conductive elements.

According to optional characteristics of embodiments of the disclosure, taken singly or in combination, and in association with the third aspect of the disclosure:

the relative spacing movement of the two portions of the splitter device causes the electrical contact between all of the distinct conductive elements of the two series to be made simultaneously or broken simultaneously;

in order to ensure contact at each of the intended contacts, means are provided to compensate for geometrical dispersions;

the distinct conductive elements of at least one of the two series are resilient;

in order to ensure contact at each of the intended contacts, resilient contact elements are interposed;

in the spaced-apart position, distinct individual free paths are created firstly between a distinct conductive element of a first series and a proximal distinct conductive element of the other series, and secondly between said proximal distinct conductive element of the other series and another distinct conductive element of the first series;

insulating obstacles are provided to limit the appearance of electric arcs between two adjacent distinct conductive elements of a given series;

for each of the portions of the splitter device, the distinct conductive elements of a given series are arranged on the insulating body in a helical arrangement, and the two helices of the two portions are coaxial and interleaved;

for each of the portions of the splitter device, the distinct conductive elements of a given series are arranged on the insulating body in a plurality of parallel rows, and the rows of the two portions are parallel and interleaved; and in the electrical contact position of the two portions of the splitter device, a nominal load current through the connection apparatus passes via the distinct conductive elements of the splitter device.

According to optional characteristics of embodiments of the disclosure, taken singly or in combination, and in association with any of the aspects of the disclosure:

a first of the two electrodes is stationary and a second of the two electrodes includes a movable connection member;

a first portion of the splitter device is carried by the first electrode; a second of the two portions of the splitter device is carried by the first portion of the splitter device or by the first electrode, with the possibility of relative spacing movement between the contact position and the spaced-apart position; the movable connection member is in contact with the second portion of the splitter device between a closed position of the movable connection member and an intermediate position of the movable connection member corresponding to the spaced-apart position of the two portions of the splitter device; and the movable connection member is spaced apart from the second portion of the splitter device between its intermediate position and an extreme open position;

between the closed and intermediate positions of the movable connection member, at least one distinct conductive element of the splitter device is electrically connected to the movable connection member by the movable connection member making contact with the second portion of the splitter device;

in the electrical contact position of the two portions of the splitter device, a nominal load current through the connection apparatus passes via electrical contact between the movable connection member and the second portion of the splitter device;

the apparatus includes a sealed enclosure enclosing an insulating fluid and in which there are arranged at least the first electrode and the second electrode, and at least some of the distinct conductive elements of the splitter device are housed in an internal cavity arranged in the first electrode or the second electrode;

the internal cavity is arranged inside an envelope determined by a conductive peripheral surface of the first electrode;

at least the second electrode includes a movable connection member that is movable along an opening movement relative to the first electrode between an extreme electrically open position and an extreme electrically closed position in which it makes a nominal electrical connection with the first electrode, and the internal cavity is arranged inside an envelope determined by a conductive peripheral surface of the movable connection member;

at least one of the portions of the splitter device is carried by the first electrode, and the relative spacing movement of the two portions is controlled by the opening movement of the electrodes between their extreme open and closed positions;

the preferred electrical path is superposed on the path of at least one of the two portions of the splitter device in its relative spacing movement;

in their relative contact position, the two portions of the splitter device make a continuous electrically-conductive path between the upstream portion and the downstream portion of the electric circuit;

the distinct individual free paths are arranged in series along the preferred electrical path;

two successive distinct individual free paths are electrically connected by one of the distinct conductive elements, each individual free path being defined between two proximal distinct conductive elements;

a distinct conductive element connects together no more than two distinct individual free paths;

at least some of the distinct individual free paths extend along a path that presents a non-zero component in projection in a direction perpendicular to the path of the opening movement of the electrodes; and at least some of the distinct individual free paths extend with overlap in the direction of the relative spacing movement of the two portions of the device with at least one other distinct individual free path.

Various other characteristics appear from the following description made with reference to the accompanying drawings, which show embodiments of the disclosure as non-limiting examples.

DESCRIPTION

Figure 1:
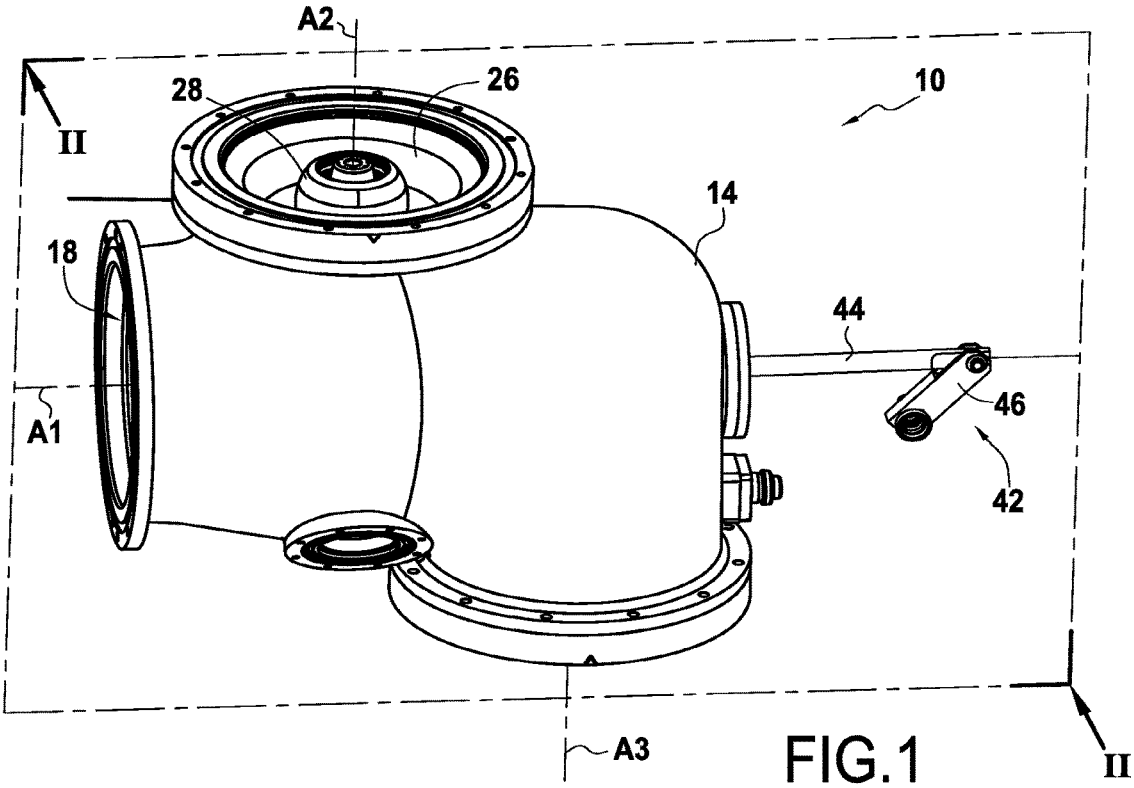
FIG. 1 is a perspective view of a breaker apparatus of the type of the disclosure.
Figure 2:
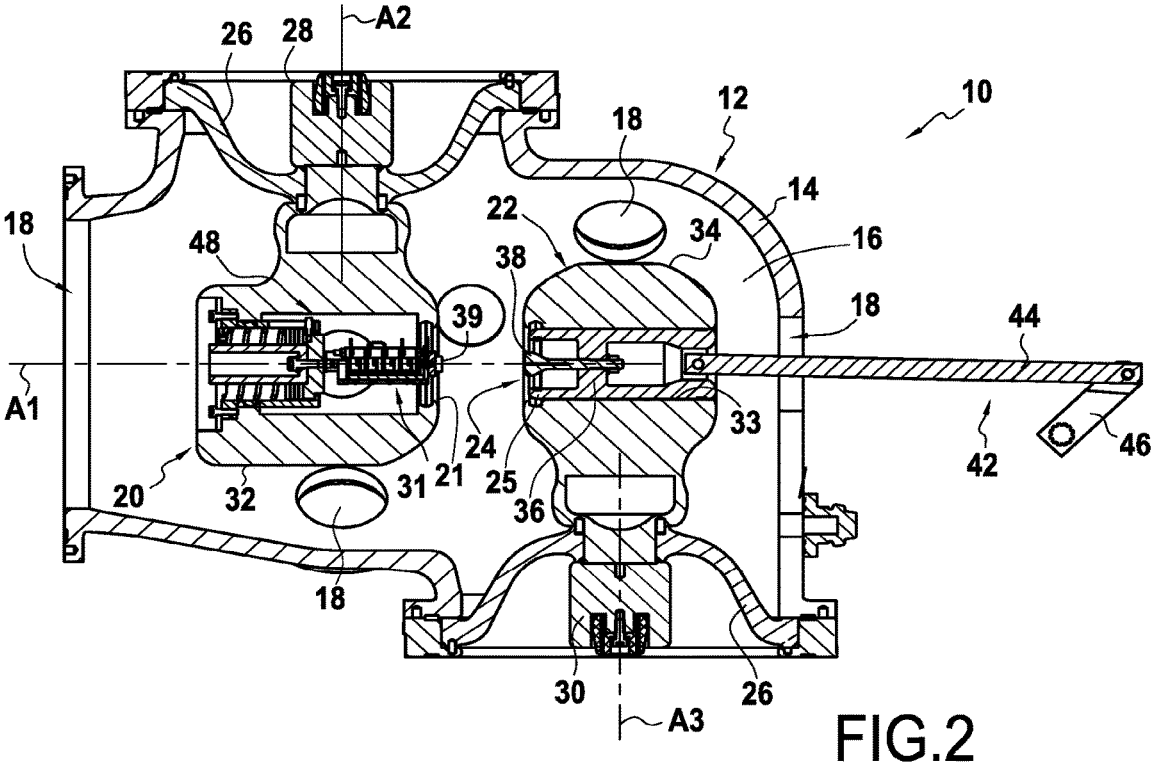
FIG. 2 is a section view of a first embodiment of a breaker apparatus according to embodiments of the disclosure.

FIGS. 1 and 2 show the main component elements of a mechanical breaker apparatus according to embodiments of the disclosure for a high voltage or very high voltage electric circuit.

Such an apparatus is to open or close an electric circuit that may convey nominal currents, i.e. established currents for which the apparatus is designed to operate continuously without damage, at a voltage higher than 1000 V for AC or 1500 V for DC, or even under very high voltage, i.e. a voltage higher than 50,000 V for AC or 75,000 V for DC.

The apparatus is a mechanical breaker apparatus insofar as the electric circuit is opened by separating and moving apart two contact parts so as to interrupt the flow of current through the apparatus. The electric circuit may be closed by moving two contact parts until they come into contact so as to reestablish a flow of current through the apparatus.

In the embodiments described below, the mechanical breaker apparatus is a disconnector. Nevertheless, embodiments of the disclosure can be implemented in the context of a circuit breaker or of a switch. In the embodiments, the breaker apparatus is designed to break a single electric circuit, e.g. one phase, however embodiments of the disclosure can be implemented in apparatus that is designed to break a plurality of electric circuits, then comprising a plurality of breaker devices in parallel, e.g. within a common enclosure.

More particularly, the disclosure is described in the context of a breaker apparatus of the so-called "metal-clad" type. The apparatus 10 thus comprises an enclosure 12 defined by a peripheral wall 14. The peripheral wall 14 defines an inside volume 16 of the enclosure 12 and is provided with a series of openings 18 that serve, at least for maintenance or assembly operations, to provide access to the inside volume 16 from outside the enclosure, or that enable the volume 16 to be put in communication with another volume of another enclosure placed next to the peripheral wall 14 around the opening. When the apparatus is in an operating configuration, the enclosure 12 may be leaktight relative to the outside of the peripheral wall 14. The openings in the wall are thus designed to be closed, e.g. by inspection ports, or caps, or to put the inside volume 16 of the enclosure 12 into communication with another enclosure that is itself leaktight, by making the opening coincide with a corresponding opening of the other enclosure. By being leaktight in this way, the internal volume 16 of the enclosure 12 can be filled with an insulating fluid that can be separated from atmospheric air. The fluid may be a gas or a liquid. The pressure of the fluid may be different from atmospheric pressure, e.g. a pressure higher than 3 bars absolute, or the pressure may be very low, possibly close to a vacuum. The insulating fluid may be air, for example, air at a pressure that is higher than atmospheric pressure. Nevertheless, the fluid may be selected because of its highly insulating properties, e.g. having dielectric strength that is greater than that of dry air under equivalent conditions of temperature and pressure.

In general manner, the apparatus 10 has at least two electrodes that are to be connected electrically respectively to an upstream portion and to a downstream portion of the electric circuit that is to be broken, and that are movable relative to each other with an opening movement between at least one electrically open position, corresponding to an open state of the apparatus, and an electrically closed position in which they make a nominal electrical connection of the apparatus, thus corresponding to a closed state of the apparatus. In the present text, the opening movement may take place in an opening direction from the electrically closed position to the electrically open position, or in the closing direction from the electrically open position to the electrically closed position. In the example shown, the apparatus 10 includes in particular a stationary first electrode 20 and a second electrode 22 that comprises a stationary main body and a movable connection member 24.

In the example shown, each electrode 20, 22 is fastened in the enclosure 12 by means of an insulating support 26, represented in this example as being in the form of a bowl that is fastened to the peripheral wall 14 so as to close an opening 18 that is provided for this purpose, the electrode being arranged on an inside of the support 26. On the outside of the support 26 relative to the inside volume 16, the support 26 carries a connection terminal 28, 30 that is electrically connected to the corresponding electrode 20, 22. The connection terminals 28, 30 are thus arranged outside the enclosure 12. One of the terminals is for connecting to an upstream portion (not shown) of the electric circuit, while the other terminal is for connecting to a downstream portion (not shown) of the electric circuit. In arbitrary manner, and without this having any particular meaning concerning the polarity or the flow direction of the current, the portion referred to as the upstream portion of the electric circuit is the portion that is connected to the first electrode 20 via the connection terminal 28. Consequently, the downstream portion of the electric circuit is the portion that is connected to the second electrode 22 via the connection terminal 30.

Each electrode 20, 22 is electrically connected in permanent manner to the associated connection terminal 28, 30, regardless of whether the breaker apparatus is in the open state or the closed state.

Each electrode 20, 22 has a stationary main body made of a conductive material, in particular a metal material, having an outer peripheral surface 32, 34 that is conductive and that presents a shape that is essentially convex without any projecting portions. As described below, each electrode 20, 22 presents an internal cavity 31, 33 contained inside the envelope defined by the conductive outer peripheral surface 32, 34 of the stationary main body.

In the example shown, the peripheral wall 14 presents a generally cylindrical shape about a central axis A1, and the two electrodes 20, 22 together with their associated terminals 28, 30 present elongate shapes, respectively along an axis A2 and along an axis A3. In this example, the axes A2 and A3 are parallel. The axes A2 and A3 are perpendicular to the central axis A1 of the wall 14 and they are offset from each other along the direction of the axis A1. In addition to being offset in this way along the direction of the central axis A1, the terminals 28 and 30 are arranged opposite from each other on either side of the central axis A1.

The main bodies of the two electrodes 20, 22 are arranged in stationary manner in the inside volume 16, being spaced apart from the peripheral wall 14 of the enclosure 12 and being spaced apart from each other in such a manner that an inter-electrode electrical insulation space is arranged along the direction of the central axis A1 between facing portions of their respective outer peripheral surfaces 32, 34.

In the example shown, the movable connection member 24 of the second electrode of the apparatus comprises a sliding tube 36 of axis A1 that is guided to slide along the central axis A1, which is arbitrarily referred to herein as being "longitudinal", in a cylindrical internal cavity of axis A1 in the stationary main body of the second electrode 22.

The connection member 24 is movable in an opening movement relative to the opposite electrode 20 between an extreme electrically open position shown in FIG. 2 and an extreme electrically closed position in which the electrical connection member 24 makes a nominal electrical connection with said opposite electrode 20. In the example shown, the sliding tube 36 of the movable connection member 24 may be made of conductive material, e.g. of metal, and it is electrically connected to the main body of the second electrode, and thus electrically connected to the associated connection terminal 30 in permanent manner, regardless of the position of the movable connection member 24.

In the example shown, when the connection member 24 is in its extreme open position, it is received entirely inside the corresponding cavity of the second electrode so as to minimize any risk of electric arcing. In its extreme closed position, the connection member 24 is moved longitudinally along the central axis A1 towards the first electrode 20 through the inter-electrode electrical insulation space. In known manner, the connection member 24 is moved between these two extreme positions by a control mechanism 42 that, in the embodiment shown, comprises a connecting rod 44 that is movable in a direction substantially parallel to the axis A1 and that is itself controlled by a rotary lever 46.

Figure 3:
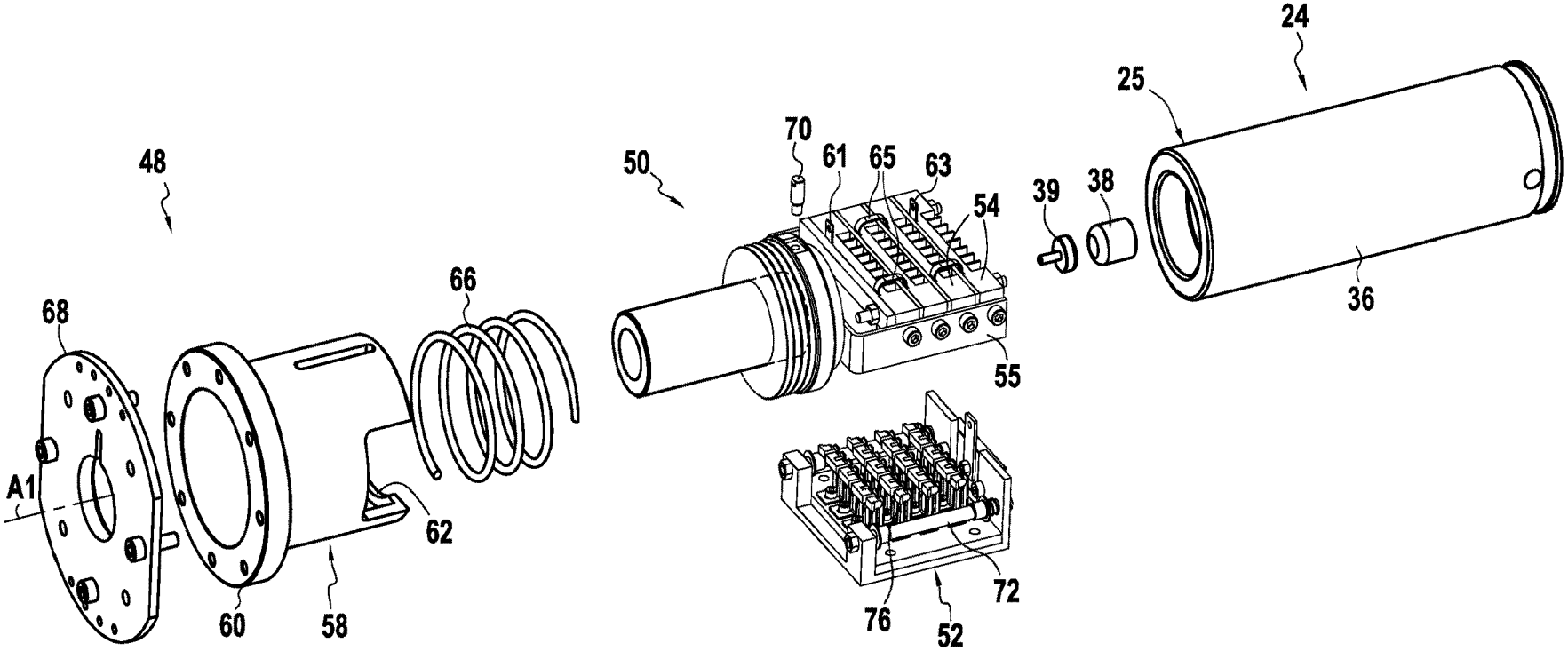
FIG. 3 is an exploded perspective view showing a first embodiment of a splitter device for an apparatus according to embodiments of the disclosure.

In arbitrary manner, the longitudinal movement of the connection member 24 is said to be "forwards" when going from its extreme open position to its extreme closed position, i.e. from right to left in FIG. 3. Consequently, the opposite direction is arbitrarily referred to as "rearwards".

It is known that a major problem with this kind of breaker apparatus is associated with electric arcs appearing while the circuit is being opened, and sometimes also while it is being closed, in particular if opening or closing is performed while the electric circuit is live and is conveying a large current. In order to handle this problem, the apparatus 10 of the disclosure includes an electric arc splitter device 48.

In the embodiment shown in FIG. 2, the electric arc splitter device 48 may be contained at least in part and possibly for the most part, or even completely in the internal cavity of one of the electrodes, specifically in the first electrode 20. By being arranged in this way inside the envelope determined by the conductive peripheral surface 32, the electric arc splitter device can be integrated in the apparatus 10 without disturbing the electric fields that exist in the inside volume when the apparatus is in its closed state. As a result, there is no need to modify the design of the apparatus in order to continue complying with the dielectric strength of the apparatus. By housing the electric arc splitter device at least in part, and possibly for the most part, or even in full in the cavity of the electrode, a limit may be put on any need to enlarge the apparatus, in particular any need to enlarge the internal volume, which is favorable to ensuring the apparatus is compact. The shape of the tank can thus continue to be somewhat cylindrical, which may be desirable in terms of substation compactness. The splitter device may be received entirely inside the internal cavity.

The splitter device 48 may be housed inside the movable connection member 24, or in a cavity of the main body of the second electrode 22. The splitter device 48 could thus be received in a cavity formed inside an envelope determined by a conductive peripheral surface of the sliding tube 36.

The operation of a first embodiment of a splitter device is described below with reference to FIGS. 3 to 10.

FIG. 3 shows the main components of a first embodiment of a splitter device 48 suitable for being used in the disclosure. FIGS. 4 to 7 show various different relative positions of these components. FIGS. 8 and 9 are diagrammatic plan views for a contact position and for a spaced-apart position of the device.

Figure 4:
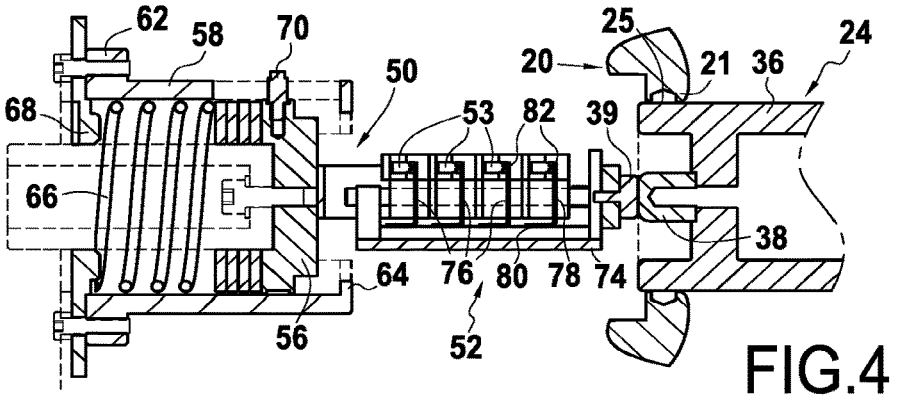
FIGS. 4 to 7 are diagrammatic views in axial section for various relative positions of the components of the FIG. 3 splitter device and of a movable connection member for an apparatus according to embodiments of the disclosure.
Figure 5:
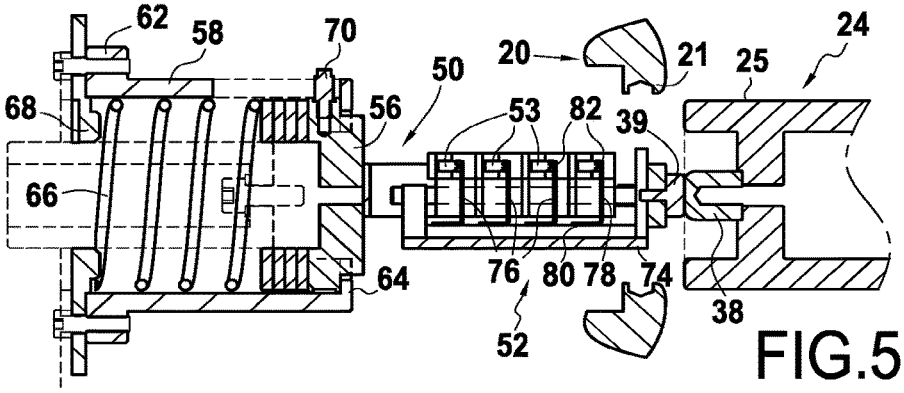
Figure 6:
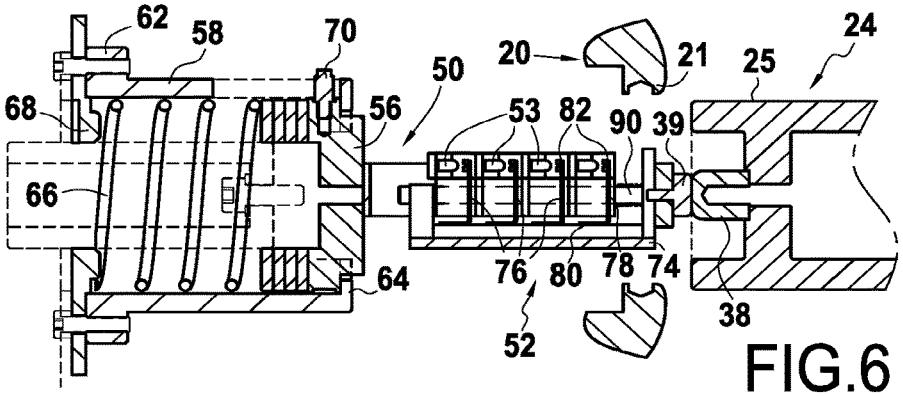
Figure 7:
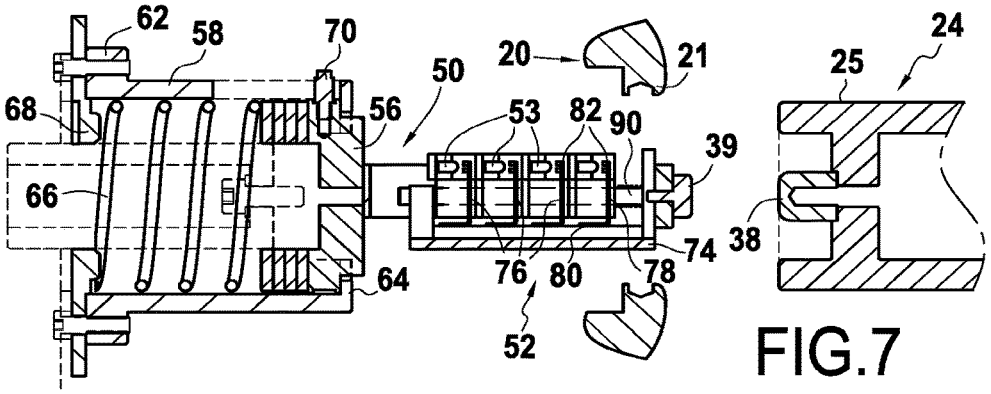
Figure 8:
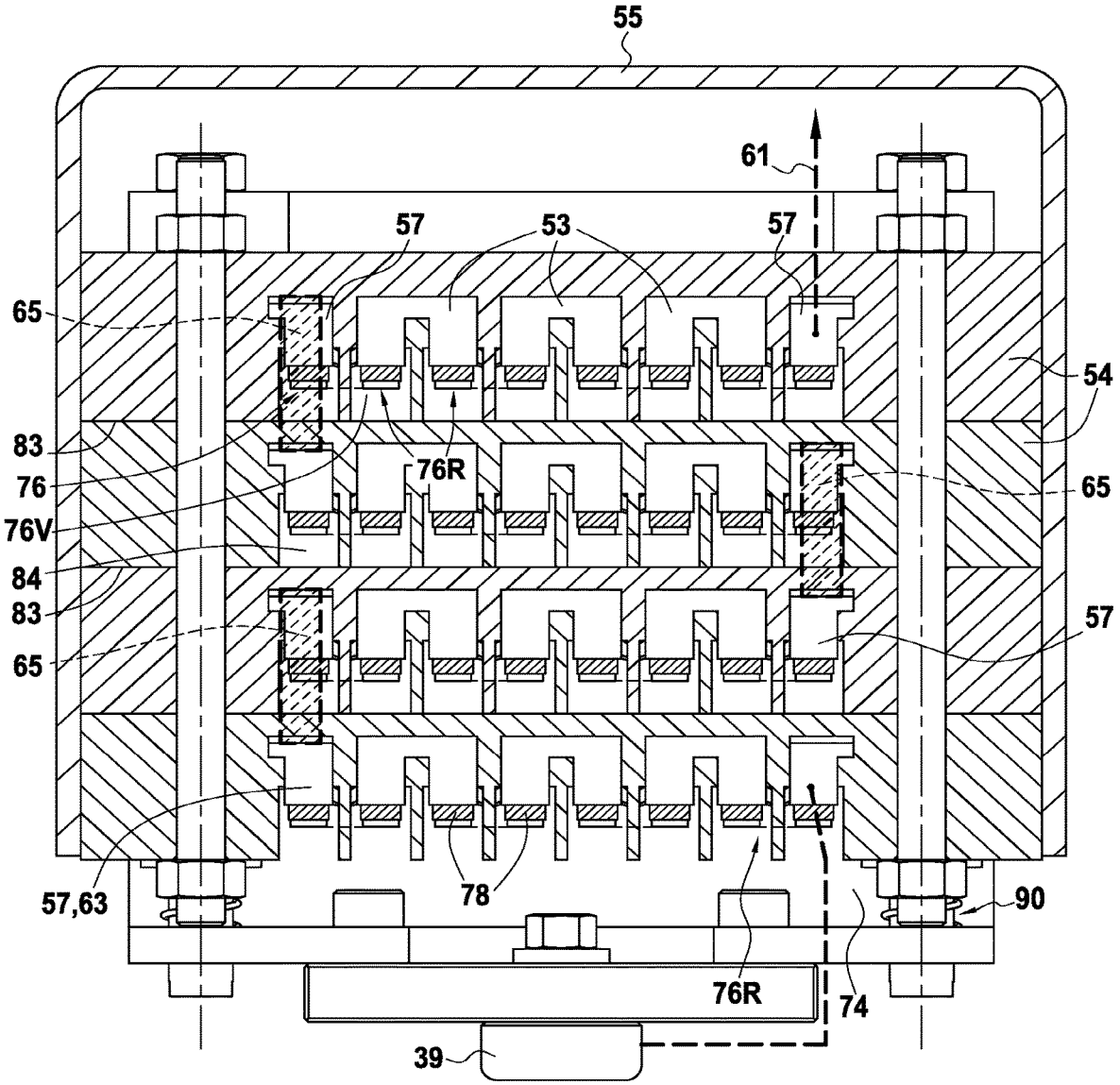
FIGS. 8 and 9 are diagrammatic views of a device of the type shown in FIGS. 4 to 7, in section on a plane containing the axial direction, showing respectively the positions of FIGS. 4 and 7.
Figure 9:
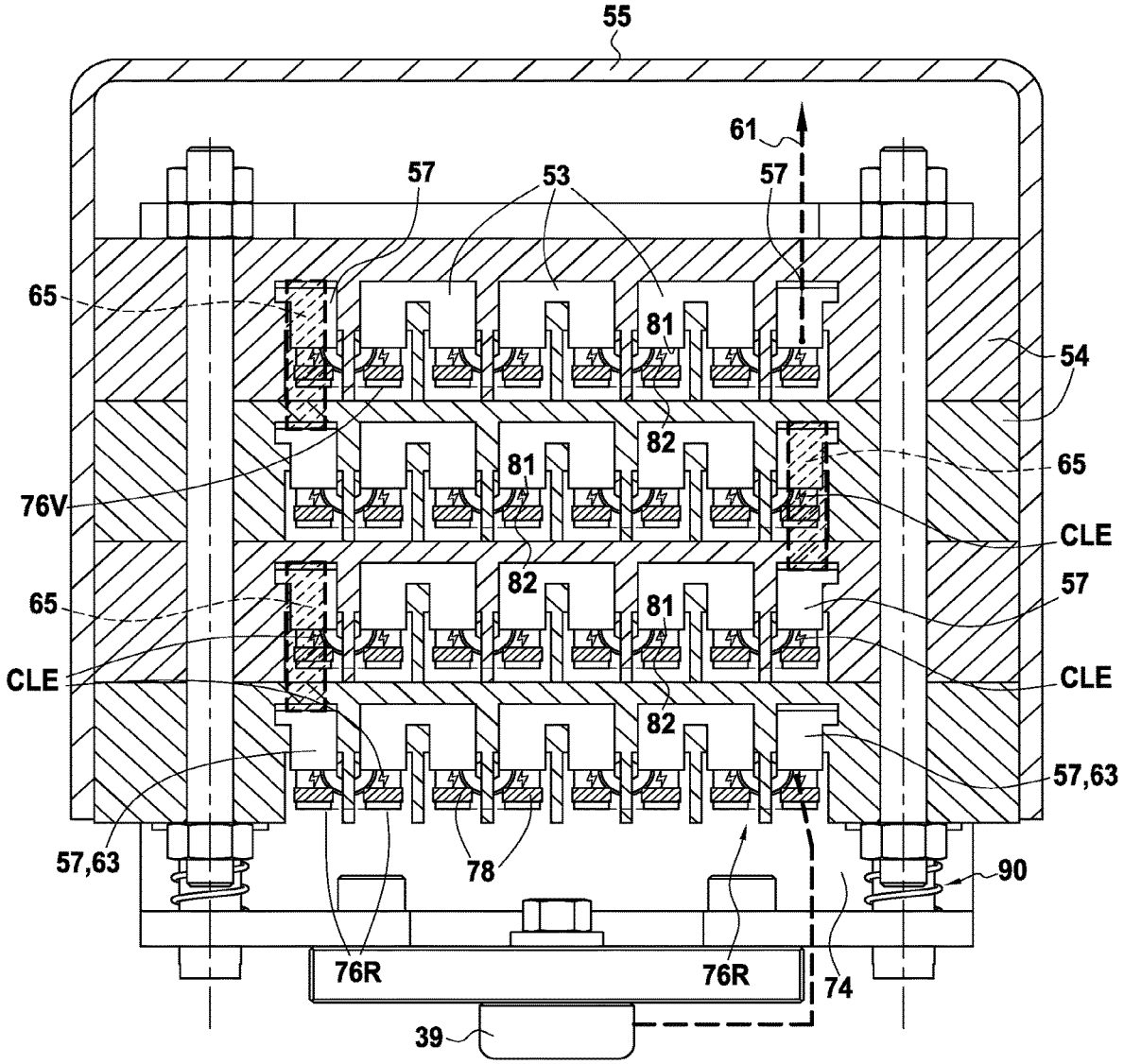

The first embodiment comprises a first portion 50 and a second portion 52 that are movable relative to each other with relative spacing movement, in this example along the direction of the central axis A1 between at least one electrical contact position, shown in FIGS. 4, 5, and 8, and a position in which the two portions are spaced apart, shown in FIGS. 6, 7, and 9. In this example, the relative spacing movement is movement in pure translation along the axis A1.

In the embodiment of the breaker apparatus that is described, the splitter device is arranged in the apparatus so that:

in an extreme closed position of the movable connection member 24, corresponding to the electrically closed position of the electrodes of the mechanical apparatus, the nominal electric current, or at least a large portion thereof, flows along a main continuous electrically-conductive path, specifically directly between the movable connection member 24 and the main body of the first electrode 20, without this majority of the nominal current passing via the splitter device 48. As can be seen in FIG. 4, the nominal current, or at least a majority thereof, flows via a pair of main contacts that are formed in this example by the front end 25 of the sliding tube 36 of the movable connection member 24 and by a contact surface 21 of the main body of the first electrode 20.

In contrast, for positions of the movable connection member 24 lying between the extreme closed position shown in FIG. 4 and a position shown in FIG. 5, and for which contact between the pair of main contacts is lost, a secondary continuous electrically-conductive path is defined for the nominal electric current through the apparatus. This secondary continuous electrically-conductive path is defined through the splitter device 48, so long as the two portions of the splitter device are still in their electrical contact relative position.

In this embodiment, each of the two portions 50, 52 has an insulating body with a series of distinct conductive elements arranged thereon that are electrically insulated from one another, where a "series" contains a plurality of distinct conductive elements. As can be seen below:

in the contact position of the two portions 50, 52, each conductive element of the two series, with the exception of the end elements, is in electrical contact with two successive distinct conductive elements of the other series; and in any spaced-apart position of the two portions, distinct from the electrical contact position of the two portions, each conductive element of two series is spaced apart from the distinct conductive elements of the other series.

Figure 10:
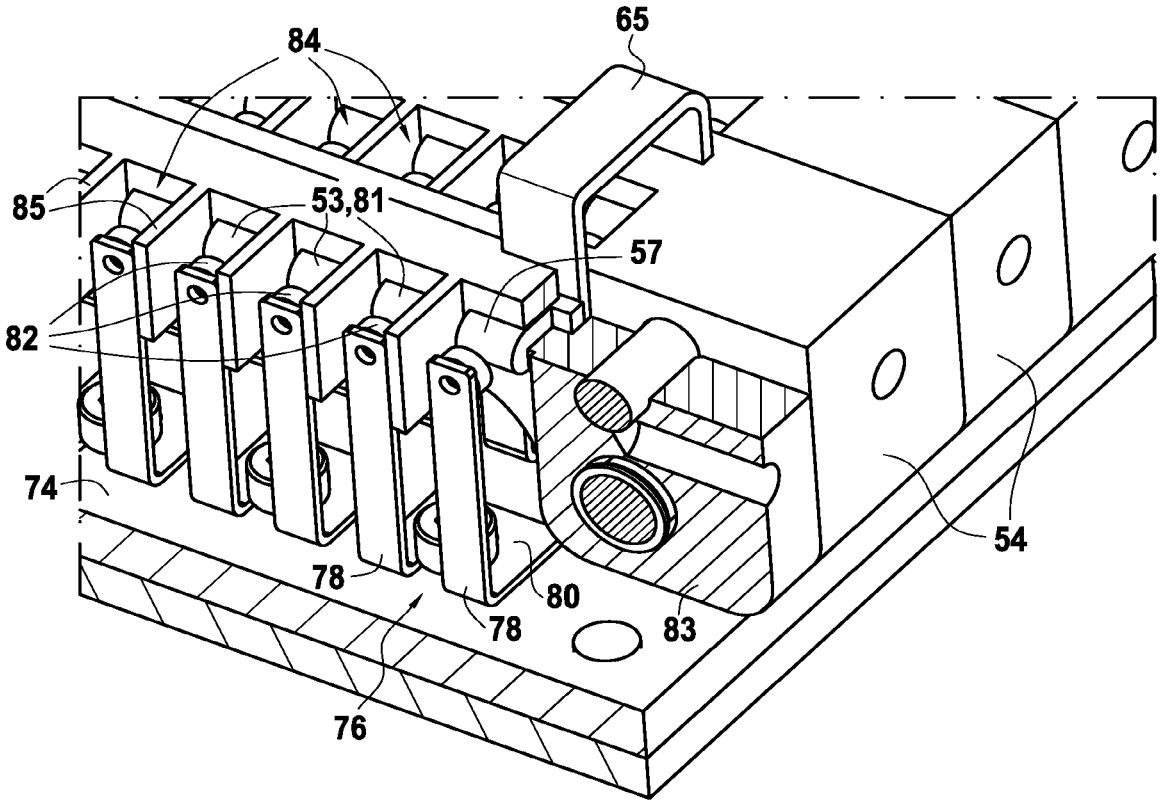
FIG. 10 is a cutaway diagrammatic perspective view of a portion of the FIG. 3 splitter device.

In FIG. 3, it can be understood that the first portion comprises a carriage carrying a plurality of bars 54 that extend in the transverse direction and that are made of insulating material, in which there is arranged a first series of distinct conductive elements 53, as can be seen in FIGS. 8, 9, and 10, which elements may for example be in the form of U-shaped jumpers.

By way of example, the bars 54 are carried by a U-shaped frame 55 that extends in a plane containing the central axis A1 and the transverse direction of the bars 54, the frame 55 being open towards the rear, specifically towards the second electrode 22. The insulating bars 54 are in the form of rectangular parallelepipeds that extend in the transverse direction and that have respective rearwardly-facing faces 83 with recesses 84. The bars 54 form an insulating body for the first portion 50 of the device.

The insulating body for the first portion 50 of the device may be made at least in part out of one or more insulating materials so as to provide electrical insulation between two adjacent distinct conductive elements of the same portion. The insulation that is obtained may prevent any dielectric breakdown or any movement of the electric arc in the material of the insulating body between the two adjacent distinct conductive elements during a stage of interrupting an arc, in particular. By way of example, the insulating body is made on the basis of polytetrafluoroethylene (PTFE), and/or on the basis of perfluoroalkoxy (PFA), and/or on the basis of polyoxymethylene (POM). In addition to their insulating character, such materials may present a strong ablation character enabling electric arcs to be cooled effectively and thus increasing voltage across their terminals, thereby having the effect of enhancing the extinction process. The main material constituting the bars 54 may present dielectric strength greater than 5 kilovolts per millimeter (kV/mm), and, for example, good resistance to the wear caused by an electric arc.

Jumpers 53 of conductive material are embedded in the insulating bars 54 so that each of the two ends of a jumper 53 is flush outside the insulating bar in one of the recesses 84 in the rear face of the bar 54 in order to form an electrical contact 81. In the example shown, each jumper 53 thus presents a transverse base portion that is embedded in the bar 54 and two parallel portions extending axially rearwards and having free ends outside the material of the bar 54 in the recesses 84 so as to form the electrical contacts 81, as can be seen in FIG. 10. The recesses 84 are also open in bottom faces of the bars. In the example shown, the bars 54 are adjacent to one another in the direction of the axis A1, but the depth of the recesses 84 in this direction leaves space between the electrical contacts 81 of the jumpers and the front face of the immediately adjacent bar 54. Each bar 54 has a plurality of jumpers 53 arranged side by side in the transverse direction. Because of the multiplicity of bars 54, the jumpers 53 are thus arranged in parallel rows.

In the disclosure, the distinct conductive elements are made out of metal, for example. Their conductive character means that they present resistivity of less than $10^{-6}$ ohm-meters (Ω·m).

In the example shown, each bar 54 includes single studs 57 on either side of the row of jumpers 53, each stud having a base portion embedded in the bar 54 and a rear portion that extends axially rearwards with its free end outside the material of the bar 54 in a recess 84 so as to form an electrical contact 81 analogous to the electrical contacts of the jumpers 53 and in alignment therewith. In this embodiment, for the set of bars, provision is made for a first single stud 57, carried by a bar 54, specifically the bar arranged at the front along the axis A1, to form a front main terminal 61 that is to be electrically connected to a portion of the electric circuit that is to be broken. In this embodiment, the front main terminal 61 is permanently connected to the associated connection terminal 28, and thus to the upstream portion of the electric circuit. In this embodiment, a second of these single studs 57, carried by a bar 54, specifically the bar arranged at the rear along the axis A1, forms a rear main terminal 63 that is for being electrically connected to the other one of the portions of the electric circuit that is to be broken. It is explained below that this electrical connection is effective only for certain positions of the movable connection member.

The other single studs are for electrically connecting together in pairs, one single stud 57 on one bar 54 being electrically connected to another single stud 57 situated, e.g. on the same transverse side, on one of the bars that is immediately adjacent, e.g. by a conductive bridge 65. The set of two single studs 57 that are connected together by a single conductive bridge 65 thus forms the equivalent of a jumper having two electrical contacts, and thus forms a conductive element that is distinct in the meaning of the disclosure.

The second portion 52 of the splitter device 48 also has a carriage that is mechanically connected to the carriage of the first portion by a slideway connection 72, thus ensuring that the two portions of the device can move relative to each other. By way of example, in the embodiment shown, each of the transverse ends of the bars 54 is provided with a cylindrical bore of axis A1 so as to enable the bars to be mounted on two parallel rods of axis A1 belonging to the second portion 52 in order to form the slideway connection between the two portions 50 and 52.

The carriage of the second portion may have a base plate 74, for example, made of insulating material, that extends in a plane parallel to the axis A1 and to the transverse direction. The second portion 52 carries a series of distinct conductive elements, embodied in this example in the form of forks 76 having two branches 78 of conductive material extending vertically upwards from the base plate 74, i.e. in a direction that is substantially perpendicular to the direction of the axis A1 and to the transverse direction. As can be seen in FIG. 10, the two branches 78 of each fork 76 are connected together by a conductive bottom cross-member 80 whereby each fork 76 is fastened on the top face of the base plate 74. The top free end portion of each branch 78 forms an electrical contact 82 that is to co-operate with a respective one of the electrical contacts 81 of the jumpers 53 of the first portion 50. The forks 76 of the second portion 52 are also arranged in parallel transverse rows, each row corresponding to a row of jumpers 53 of the first portion. The electrical contacts 82 of the forks 76 may be made in material continuity with the remainder of the forks, or they may be in the form of fitted elements. If they are fitted elements, the electrical contacts 82 may be made of a conductive material that is different from the materials used for the remainder of the forks 76, and in particular of a material that withstands electric arcs well. They may thus be made on the basis of tungsten or cupro-tungsten, while the remainder or the fork is then made on the basis of copper, for example.

As can be seen in particular in FIGS. 8 to 10, the two portions 50 and 52 are arranged relative to each other in such a manner that each branch 78 of a fork 76 is engaged in a recess 84 vertically from the bottom in such a manner that, in the direction of the axis A1, an electrical contact 82 of each branch 78 of the fork 76 faces an electrical contact 81 of a jumper 53 of the first portion. It can thus be observed that the base plate 74 of the second portion 52 is arranged below the insulating bars 54. It can thus be seen, e.g. in FIG. 9, that for each of the portions 50, 52 of the splitter device, the distinct conductive elements of a given series are arranged on the insulating body 54, 74 of the corresponding portion in a plurality of parallel rows, and that the rows of the two portions are parallel and interleaved, in the sense that a row of elements of one series, and thus belonging to one portion of the splitter device, is arranged between two rows of elements of the other series, and thus belonging to the other portion of the splitter device.

It can be seen in FIG. 10 that the recesses 84 possess a dimension in the direction of the axis A1 that makes it possible, by relative axial movement of the two portions 50 and 52 of the splitter device, for there to be an electrical contact position as shown in FIGS. 4, 5, and 8, and a spaced-apart position without electrical contact as shown in FIGS. 6, 7, and 9. The relative movement, as determined in this example by the slideway, is movement in pure translation along the axis A1.

This embodiment of the disclosure thus has two distinct series of distinct conductive elements, one carried by the first portion and the other carried by the second portion. For at least one active state of the splitter device, corresponding in this example to a spaced-apart position of the two portions of the device, the distinct conductive elements are spaced apart and electrically insulated from one another so as to define within the surrounding insulating fluid a multitude of successive distinct individual free paths CLE in which electric arcs can be struck on opening and/or closing the electric circuit. Each individual free path CLE is an empty space in the surrounding insulating fluid between two distinct conductive elements, i.e. a path without any solid obstacle, in particular without any insulating solid obstacle.

For a spaced-apart position of its two portions, the splitter device 48 defines a preferred electrical path between the upstream portion and the downstream portion of the electric circuit, which preferred electrical path comprises conductive sections comprising the distinct conductive elements, specifically the jumpers 53 and the forks 76, alternating with and insulating sections comprising the successive distinct individual free paths.

The successive distinct individual free paths CLE are considered to be sections that are insulating insofar as they correspond to a space in a fluid that, in the absence of an electric arc, may present greater insulation than dry air, as defined above. In the presence of an electric arc, the distinct individual free paths may lose their insulating character.

Nevertheless, it should be observed that the jumpers 53 are offset transversely relative to the forks such that, when the two portions 50 and 52 are in a contact position, each fork 76 is designed to come into contact via its two contacts 82 with two contacts 81 that belong to two adjacent jumpers in the corresponding row. Thus, in the contact position, a fork 76 makes an electrical connection between two adjacent jumpers 53. One of these adjacent jumpers may have two single studs 57 connected together by a conductive bridge 65, with one fork being in contact with one of the studs and another fork, belonging to another row being in contact with the other one of the studs.

In this embodiment, in the spaced-apart position, the distinct individual free paths are created firstly between a jumper 53 of the first series and a proximal fork 76 of the other series, as carried by the second portion 52, and secondly between said proximal fork 76 and another jumper 53 of the first series.

In this first embodiment, the splitter device 48 has a contactor 39 that is arranged at the rear end of the device and that is thus carried by the carriage of the second portion of the splitter device. The contactor 39 is designed to be in contact with the connection member 24 when the apparatus is in its closed state, and more particularly in this example with a contactor 38 of the connection member 24. In contrast, when the connection member 24 has reached an open position, the electrical contact between the contactor 38 of the movable connection 24 and the contactor 39 is broken. The contactor 39 is electrically connected to one of the distinct elements of the splitter device 48, more precisely to the element that acts as the rear main terminal 63. In this first embodiment, the contactor 39 is electrically connected to the rear terminal 63, which is carried by the first portion of the splitter device 48.

The first embodiment device of the disclosure also has an end-of-stroke absorber mechanism for absorbing the end of the stroke of the movable connection member so as to ensure an intermediate state of the breaker apparatus between the nominal closed state corresponding to the extreme position of the movable connection member 24, as shown in FIG. 4, and a secondary closed state of the apparatus corresponding to the position shown in FIG. 5.

To do this, the end-of-stroke absorber mechanism enables the two portions 50 and 52 of the splitter device 48 to move together in the movement direction of the movable connection member 24, specifically in this example in the direction of the axis A1, from a first contact position between the two portions as shown in FIG. 5 to an offset position as shown in FIG. 4.

In the position of FIG. 4, the movable connection member 24 is in direct contact with the body of the electrode via the contact surface 21. The contact may be radial contact between a cylindrical portion of the front end 25 of the sliding tube 36 and the contact surface 21 so as to guarantee electrical contact even in the event of position dispersion along the direction of the axis A1. In this state of the apparatus, the nominal electric current, or at least a major portion thereof, flows along a main continuous electrically-conductive path, specifically directly between the movable connection member 24 and the main body of the first electrode 20.

On moving towards the rear, towards the position shown in FIG. 5, the front end 25 of the sliding tube 36 loses contact with the contact surface 21. Nevertheless, up to the position of FIG. 5, it can be seen that a secondary continuous electrically-conductive path is defined for the nominal electric current through the apparatus. This secondary continuous electrically-conductive path is defined through the splitter device 48 so long as the two portions of the splitter device are still in their electrical contact relative position. For all of the positions between the position of FIG. 4 and the position of FIG. 5, the contactor 38 of the movable connection member is in contact with the contactor 39 carried by the first electrode 20 in order to establish the secondary continuous electrically-conductive path through the splitter device having its two portions in an electrical contact position.

To do this, the transverse base of the U-shaped frame 55, belonging to the first portion 50, is secured to a guide assembly 56 that extends rearwards from the U-shaped base. The guide assembly 56 is received so as to be capable of sliding longitudinally inside a socket 58, which is cylindrical in this example and which is designed to be fastened in the internal cavity 31 of the first electrode 20. By way of example, the socket 58 presents a tubular body of axis A1 with its front portion presenting a fastener flange 62 for fastening to the main body of the first electrode 20, and with its rear portion presenting an inwardly-directed radial flange 64 that is to form a longitudinally rear abutment for the guide assembly 56. The socket 58 is thus stationary in the mechanical breaker apparatus. The guide assembly 56, and with it the entire first portion 50 of the splitter device, is designed specifically to slide along the longitudinal direction of the axis A1 inside the socket 58 between an offset advanced position shown in FIG. 4 and a retracted position shown in FIG. 5, in which the guide assembly 56 is longitudinally in abutment rearwards against the inwardly-directed radial flange 64 of the socket 58. The guide assembly 56 is urged resiliently along the longitudinal direction towards its retracted position, e.g. by a helical spring 66 that is held inside the socket 58 by a front closure plate 68, the spring 66 thus being compressed along the axis A1 between the closure plate 68 and the guide assembly 56. An index finger 70 is fastened to the guide assembly 56 so as to project radially outwards relative to an outer cylindrical wall of the guide assembly 56 and be received in a longitudinal groove of the tubular body of the socket 58 in order to index the first portion 50 angularly.

The various operational positions of the splitter system 48 are described below with reference to FIGS. 4 to 7.

FIG. 7 corresponds to an extreme open position of the connection member 24. This position corresponds to the position of the connection member 24 that makes it possible to obtain the breaking capacity desired for the apparatus and the nominal insulation distance for the expected service conditions of the apparatus. It generally corresponds to the most retracted position of the connection member 24 allowed by the control mechanism 42 shown in FIG. 2. In this position of the connection member 24, the splitter device 48 is subjected solely to the force of the spring 66, which thus urges the first portion 50 towards its retracted position as shown in FIGS. 5 to 7. In this open state of the apparatus, the second portion 52 of the splitter device 48, which in this embodiment is carried by the first portion 50, is urged by a resilient member, e.g. a spring 90, towards a position that is spaced apart from the first portion, specifically retracted rearwards along the direction of the axis A1. By way of example, this spaced-apart position is defined by a mechanical abutment acting between the two portions 50 and 52 in the direction of their relative movement. In this relative position of the two portions, there is no electrical contact between the two portions 50 and 52, in particular no electrical contact between the distinct conductive elements of the first portion, i.e. the jumpers 53, and the distinct conductive elements of the second portion, i.e. the forks 76. It may be observed that there then exists a large distance between the contactor 39 of the splitter device, specifically carried by the second portion 52 at its rear end, and the contactor 38 of the connection member 24.

It can be understood that this state of the apparatus corresponds to its open state in which no electrical connection is made through the apparatus between the upstream and downstream portions of the electric circuit, at least under nominal operating conditions of the apparatus.

By moving the connection member 24 with its opening movement, in this example in the direction for closing the electric circuit, the intermediate position shown in FIG. 6 is reached, which corresponds to the position in which the first contact is made between the contactor 38 of the connection member 24 and the contactor 39 of the splitter device 48. In this position, there is still no movement of the two portions of the splitter device relative to each other, so they are still in their relatively spaced-apart position, nor is there any movement of the splitter device 48 as a whole relative to the socket 58, and thus relative to the first electrode 20. For this intermediate position of the connection member 24, in which electrical contact is made between the connection member 24 and the splitter device 48, the breaker apparatus is still in an electrically open state. There is no direct electrical contact between the upstream and downstream portions of the electric circuit for breaking. In contrast, it may be that the capacity of the breaker apparatus for providing electrical insulation in this position or in a position that is intermediate between the positions of FIG. 6 and of FIG. 5, i.e. the maximum voltage that it may be necessary to withstand between the upstream and downstream portions of the electric circuit without electric arcs forming, is less than its capacity for electrical insulation corresponding to the extreme open position of the connection member 24. Specifically, in this state, the rear end terminal 63 of the splitter device is taken to the potential of the downstream portion of the electric circuit via the movable connection member 24 and the contactors 38 and 39.

By continuing to move the connection member 24 in its opening movement, still in the direction for closing the electric circuit, the position shown in FIG. 5 is reached, which corresponds to the position in which the two portions 50 and 52 of the splitter device are in the electrical contact position. In this position, all electrical contacts between the distinct conductive elements of one portion and the distinct conductive elements of the other portion are made and effective. Thus, the contacts 82 of the forks 76 are bearing against the contacts 81 of the jumpers 53 so as to provide electrical contact between the various distinct conductive elements. It should also be observed that in this position, as can be seen in FIG. 8, a front end fork 76V is in contact with the front main terminal 61, and a rear end fork 76R is in electrical contact with the rear main terminal 63. In the example shown, the front and rear main terminals 61 and 63 are formed by single studs 57 carried by the first portion of the device. Nevertheless, the two terminals could be carried by the second portion of the device, or it would also be possible to provide for one main terminal to be carried by the first portion and the other main terminal to be carried by the second portion.

For this relative contact position of the two portions 50 and 52, provision may be made for it to correspond not to a first contact position between the various distinct conductive elements 76, 53, but rather for it to correspond to a relative position of the two portions beyond a first contact position towards the front in the direction of relative movement between the two portions. This is made possible in this embodiment by the fact that the contacts 82 of the forks 76 are arranged at the free ends of the branches 78 of the U-shaped forks 76, which branches 78 extend perpendicularly to the direction of relative movement between the two portions, and can deform elastically in order to absorb the movement of the base plate 74 of the second portion, which carries the bases of the forks 76, beyond a first contact position. This imparts sufficient pressure between the two contacting parts 81, 82 to allow current to flow without damage during the time needed for setting up the nominal current along the secondary continuous electrically-conductive path. A result of the same kind could be obtained by making provision for the jumpers 53 to be mounted in the bars 54 with an ability to move in the direction of relative movement between the two portions, for example by being urged resiliently towards a retracted position towards the rear along the axis A1. The electrical contact position as shown in particular in FIG. 5 and in FIG. 8 may be determined by mechanical abutments between the two portions of the splitter device 48, preventing these two portions for continuing their relative movement towards each other.

Starting from this relative position of the various components of the apparatus, as shown in FIG. 5, the breaker apparatus is in an electrically closed state in which a secondary electrical connection of the apparatus is set up. In this position, a nominal electric current can flow through the breaker apparatus 10. This nominal electric current flows along the secondary continuous electrically-conductive circuit through the splitter device prior to flowing along the main continuous electrical conductive circuit once the pair of main electrical contacts 21, 25 have come into contact, as shown in FIG. 4.

It should thus be observed that the movement of the connection member 24 towards its extreme closed position shown in FIG. 4, continues towards the front from the position shown in FIG. 5. This movement is made possible in particular by the end-of-stroke absorber mechanism, with the two portions of the splitter device 48 thus moving together in the movement direction of the connection member, specifically by the guide assembly 56 of the first portion 50 sliding in the socket 58. The two portions of the splitter device may remain in their electrical contact relative position.

In this embodiment, it should thus be observed that between the positions of FIGS. 4 and 5, so long as the pair of main contacts 21 and 25 are not in contact, a nominal load current passes through the breaker apparatus with the two portions 50 and 52 of the splitter device 48 in electrical contact via the distinct conductive elements 76, 53 of the splitter device 48, which elements are arranged along the secondary continuous electrically-conductive circuit. With reference to FIG. 8 and assuming that the front main terminal 57 of the splitter device is electrically connected in permanent manner to the upstream portion of the electric circuit that is to be broken, in particular by the main body of the first electrode 20 and by the connection terminal 28, it can be understood that the electric current is then conveyed by direct conduction from the front end terminal 57 towards a first jumper 53 of the first portion by the front end fork 76V. This first jumper 53 conveys the current to a second fork 76 adjacent to the first via their respective facing contacts, and the second fork conveys the current to a second jumper 53 adjacent to the first jumper, via their respective facing contacts. This current conduction continues through the various successive distinct conductive elements, given that the two series of distinct conductive elements are interleaved relative to each other along the continuous electrically-conductive path, such that the nominal electric current flows by passing in alternation from a distinct conductive element of one series carried by one portion of the splitter device to a distinct conductive element of the other series carried by the other portion of the splitter device.

Thus, in their contact relative position, the distinct conductive elements 53, 76 forming parts respectively of the two portions 50 and 52 of the splitter device make, by being put into contact, an electrically-conductive path between the upstream portion and the downstream portion of the electric circuit, which path is continuous, i.e. without any interruption to electrical conduction through a conductive solid medium. In the absence of contact between the main contacts 21, 25, this continuous electrically-conductive path is a path of least electrical resistance between the upstream portion and the downstream portion of the electric circuit for the contact position of the members of the apparatus. The distinct conductive elements are arranged in series along the continuous electrically-conductive path.

There follows a description of a step of opening the electric circuit, possibly performed under load, while the nominal current is flowing through the apparatus.

In the state of FIG. 4, the apparatus simultaneously presents both the main continuous electrically-conductive path directly from the main body of the stationary electrode 20 to the movable connection member 24 via the main contacts 21 and 25, and also the secondary continuous electrically-conductive path. Nevertheless, the main continuous electrically-conductive path may present lower resistance, such that a majority of the nominal current through the apparatus flows along the main continuous electrically-conductive path rather than along the secondary continuous electrically-conductive path.

Starting from the state described with reference to FIG. 4, the movable connection member 24 is controlled to retract. Until reaching the position of FIG. 5, the entire splitter device 48 retracts with the connection member 24 insofar as the guide assembly 56 of the first portion 50 of the device 48 is free to slide relative to the socket 58. During this movement, the nominal electric current flows through the breaker apparatus. Nevertheless, this nominal electric current is transferred from the main continuous electrically-conductive path to the secondary continuous electrically-conductive path through the splitter device 48, as a result of the main continuous electrically-conductive path being broken by loss of contact between the main contacts 21 and 25. Nevertheless, since both continuous electrically-conductive paths were already made, this transfer takes place without any risk of an electric arc being created.

On reaching the position of FIG. 5, corresponding to a first intermediate position of the movable connection member 24, the guide assembly 56 comes into abutment against the radial flange 64 of the socket 58, preventing any subsequent rearward movement of the first portion 50 of the device 48. In this state, the nominal current can still flow along the secondary continuous electrically-conductive path through the splitter device 48.

When the movable connection member 24 continues its rearward opening movement, in the opening direction, beyond the position of FIG. 5, the spring 90 that is arranged between the two portions of the splitter device pushes the second portion 52 of the device 48 so as to keep it pressed via its contactor 39 against the contactor 38 of the movable connection member. The two portions 50 and 52 thus move apart from each other along their spacing movement, and the contacts between the forks 76 and the jumpers 53, i.e. the electrical contacts between the two portions 50 and 52 of the device are broken simultaneously, ignoring geometrical dispersions. In this state, it can thus be seen that at each of the contacts 81, 82 of the forks 76 with the jumpers 53, respective distinct individual free paths CLE are created simultaneously corresponding to the empty spaces in the insulating fluid that are created between the pairs of contacts 81, 82 as a result of the two portions 50 and 52 moving relatively apart from each other. For the position shown in FIG. 5, it can be considered that each distinct individual free path CLE is of zero length since the two portions are in the contact position, and that the length of each individual free path increases progressively starting from this zero value and simultaneously for all of the individual free paths, in proportion to the spacing apart of the two portions 50 and 52 of the splitter device 48 from the electrical contact position towards at least one spaced-apart position of the two portions.

In the position that follows immediately after losing contact, this length of the individual free paths is so small that electric arcs are struck in each of the individual free paths CLE. In the presence of these electric arcs, current flows through the breaker apparatus 10 and through the splitter device 48. As a result of the way the system is configured, the electric arcs that appear in the individual free paths are connected in series along the flow path of the current. Specifically, the current is then constrained to flow along the preferred electrical path that comprises in alternation conductive sections constituted by the distinct conductive elements, namely the jumpers 53 and the forks 76, and "insulating" sections made up of the successive distinct individual free paths. Once more, it should be understood that in the presence of an arc, an individual free path CLE has lost its insulating character, but can recover it as soon as the arc is extinguished.

In each distinct individual free path, the electric arc in the individual path creates an arc voltage that opposes the voltage across the electrical apparatus between the upstream and downstream portions of the electric circuit that is to be broken. In known manner, this arc voltage has a value that can be written in the following form (to a first approximation and for a constant current):

$$U\,\text{arc}=Uo+k\square l_{CLE}$$

where:

Uo is a constant, generally of the order of 10 V to 25 V;

k is a multiplicative factor that may be considered as being constant; and $l_{CLE}$ is a value that represents the length of the individual free path, i.e. a value representative of the distance in the position under consideration between the contact 81 of a jumper 53 and the facing contact 82 of a fork 76.

In this embodiment, it can be understood that by creating a multitude of individual free paths simultaneously in the preferred electrical path through the splitter device 48, an arc voltage is created in each individual free path that opposes the passage of the current, with these arc voltages adding together since the individual free paths are in series along the preferred electrical path. Thus, for a splitter device that simultaneously creates N individual free paths (which in the example shown assumes (N/2)−1 distinct conductive elements in the first series and N/2 distinct conductive elements in the second series, plus the front and rear end terminals), a total arc voltage is created immediately along the preferred electrical path that is not less than N□Uo.

It can also be understood that as the two portions of the splitter device 48 move further apart, the $k\square l_{CLE}$ term for the arc voltage in each arc increases in proportion to the spacing between the two portions, and for the splitter device as a whole this portion of the total arc voltage increases with the factor N representing the number of individual free paths, and thus very quickly.

In this first embodiment, the first series of distinct conductive elements as carried by the first portion 50 comprises four rows of three jumpers 53, each row lying between a single stud 57 at each transverse end. The second series of distinct conductive elements, as carried by the second portion 50, comprises four rows of four forks 76. On opening, the splitter device 48 thus forms simultaneously thirty-two distinct individual free paths CLE in series along the preferred electrical path.

Thus, in this embodiment, even with small relative spacing between the two portions of the splitter device, and thus even for small relative movement between the two electrodes in their opening movement, a total arc voltage is created that quickly becomes large and that is of a value that increases very quickly with relative movement between the two electrodes.

Furthermore, because the splitter device 48 is arranged inside a cavity 31 of one of the electrodes, the electric arcs are confined inside the electrode and present little risk of degenerating by going to the wall 14 of the enclosure.

When the system reaches the position of FIG. 6, the total arc voltage through the splitter device 48 may have reached a value such that it causes the electric arc to disappear. In the position shown in FIG. 6, the second portion 52 of the device 48 has reached its position of maximum spacing relative to the first portion 50 and can no longer retract towards the second electrode 22.

Under all circumstances, when the movable connection member 24 continues its retraction movement from the position of FIG. 6 towards the position of FIG. 7, the contactor 38 of the connection member 24 loses contact with the contactor 39 of the splitter device 48, and moves progressively away therefrom. If an electric current is still present at the moment contact is lost (assuming that the electric arcs in the splitter device are not yet extinguished) then an electric arc may be created between the two contactors 38 and 39 in the same manner as in a conventional apparatus. Nevertheless, this arc between the two contactors 38 and 39, which creates an additional arc voltage that adds to the total arc voltage inside the splitter device 48, will normally lead quickly to the electric arcs in the apparatus being extinguished, with this happening at a relatively small value for the spacing between the two contactors 38 and 39, which value is sufficiently small to avoid creating any risk of seeing the arc degenerate by going to the wall 14 of the apparatus.

A second embodiment of the disclosure is described below that makes use of the same operating principle, but merely with a different geometrical configuration for the distinct conductive elements. As in the first embodiment, this second embodiment presents two portions that are movable relative to each other between a contact position and a spaced-apart position. Each portion 50, 52 comprises an insulating body, the insulating body of each portion carrying a series of distinct conductive elements. As in the first embodiment, a multitude of distinct individual free paths are created simultaneously (ignoring geometrical dispersions) in series along a preferred electrical path through the splitter device, with the individual lengths of these electrical paths increasing simultaneously and in proportion to the movement apart between the two portions of the device.

Figure 12:
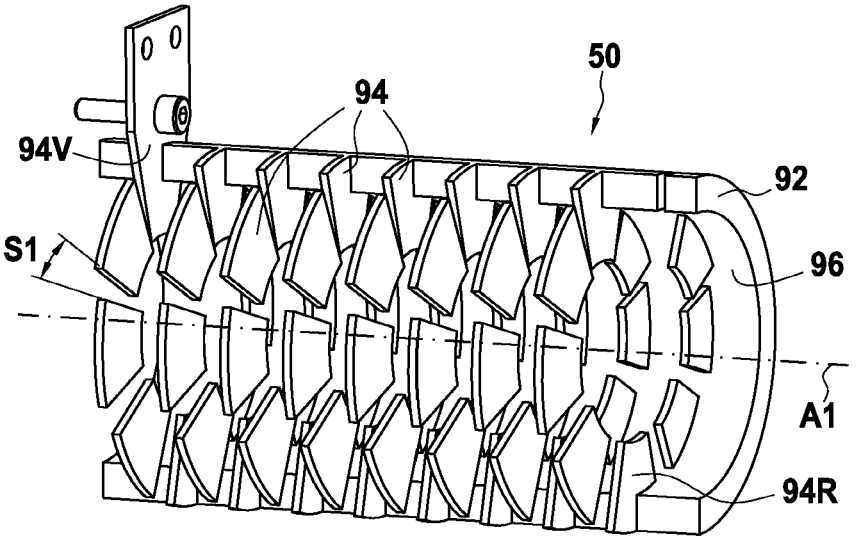
FIGS. 12 and 13 are perspective views showing respectively first and second portions of the FIG. 11 splitter device.

As can be seen more particularly in FIG. 12, the first portion 50 comprises an insulating body 92 that is tubular, in this example about the axis A1, and that has primary contact plates 94 of conductive material plugged into it, each plate forming a distinct conductive element of the first portion 50. Each primary plate 94 extends radially inwards towards the axis A1 from an inside cylindrical wall 96 of the tubular insulating body 92. Each primary plate 94 presents the shape of an angular sector of an annulus of axis A1 that extends angularly about the axis A1, e.g. in the range 5° to 30°, for example, in the range 10° to 20°, and that extends radially relative to the axis A1 from the inside cylindrical wall 96 to an inner diameter of the plates 94. Each primary plate 94 thus presents a front face and a rear face that are substantially plane and that lie in planes that are perpendicular to the axis A1.

Figure 11:
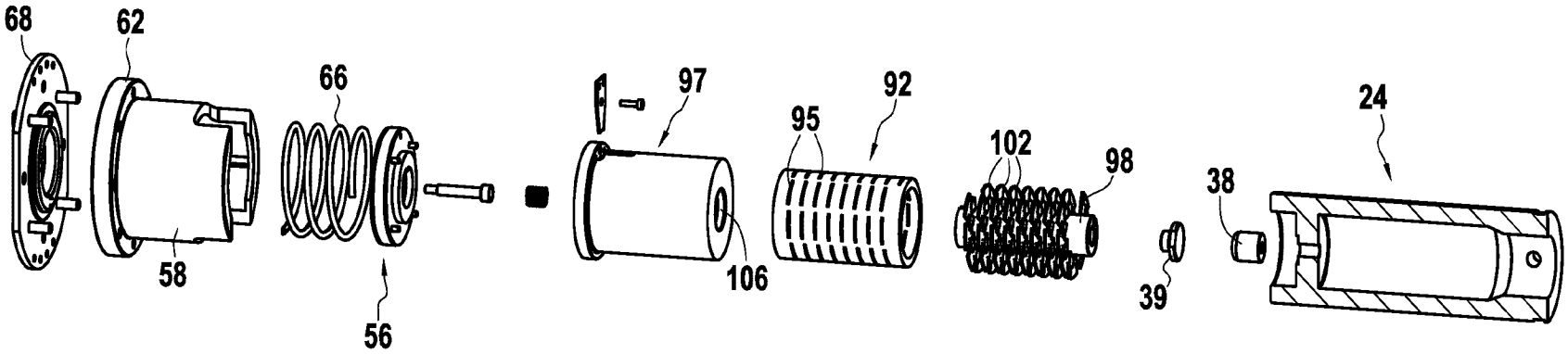
FIG. 11 is an exploded perspective view showing a second embodiment of a splitter device for an apparatus according to embodiments of the disclosure.

The primary plates 94 may be all identical in shape. As can be seen in FIGS. 11 and 12, the primary plates 94 are received in corresponding housings 95 formed in the insulating body 92 and they are arranged in a helical configuration. Thus, two successive primary plates 94 are longitudinally offset in the direction of the axis A1. The axial offset D between two adjacent plates, e.g. as measured between the respective rear faces of two adjacent primary plates, may lie in the range 0.5 millimeters (mm) to 20 mm, for example, and for example, in the range 1 mm to 5 mm. In this embodiment, two adjacent primary plates 94 are also offset angularly so as to present no facing portions in the axial direction. Between two adjacent primary plates, provision may be made for example for a primary angular gap S1 about the axis A1, this angular gap S1 being measured between facing edges, one of which belongs to one of the plates and the other to the following plate, this angular gap S1 may lie in the range 0.5° to 30°, and for example, in the range 5° to 20°. Thus, in projection along the direction of the axis A1, two adjacent primary plates 94 do not overlap. In the embodiment shown, and looking at the set of primary plates 94 along the direction of the axis A1 from the rear end of the splitter device 48, two adjacent primary plates 94 are arranged in such a manner that the primary plate 94 that is offset angularly clockwise from the other primary plate is also offset axially forwards relative to that other primary plate. With the exception of a front end primary plate 94V and of a rear end primary plate 94R, each primary plate 94 is thus located between two adjacent primary plates, which are the primary plates that are the closest to the primary plate 94 under consideration, both angularly and axially, and the three plates are considered as being successive in the first series of plates. In the example shown, the front end plate 94V is designed to form a front end terminal that is to be electrically connected, for example, in a permanent manner, to a portion of the electric circuit that is to be broken, e.g. an upstream portion.

In the example shown, each turn of the helix on which the primary plates 94 are arranged has eight primary plates that are mutually spaced apart and electrically insulated from one another. In this example, provision is made for the helix to have eight turns, giving sixty-four primary plates 94.

In the example shown, the first portion 50 of the splitter device 48 also has an outer envelope 97 that is made in the form of a tubular part of axis A1, for example made out of electrically insulating material, e.g. out of PTFE. The inside diameter of the tubular outer envelope 97 may be substantially equal to the outside diameter of the insulating body 92 of the first portion 50 so that it can be received when fitted with its primary plate 94 inside the outer envelope 97. At its front axial end, the outer envelope 97 presents a radial flange enabling it to be connected to an annular guide assembly 56 that, as in the first embodiment, is designed to be slidably received along the axis A1 in a socket 58 so as to form an end-of-stroke absorber mechanism for the connection member 24, and as described with reference to the first embodiment.

Figure 13:
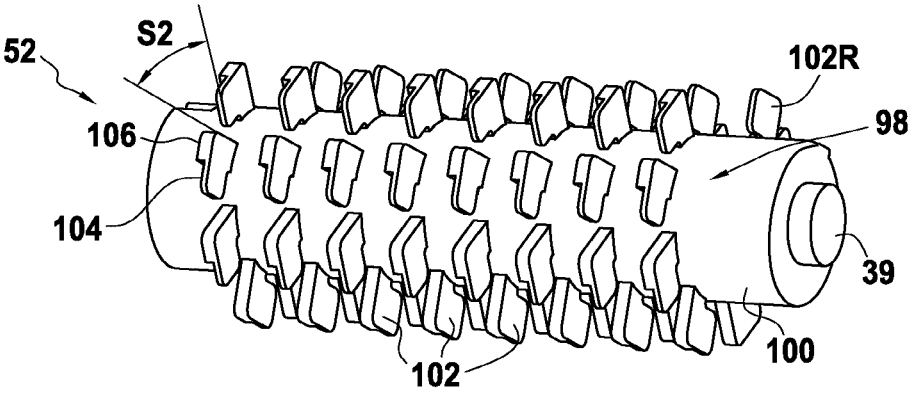

The second portion 52 of the splitter device 48, visible in FIG. 13, comprises an insulating body 98, specifically a cylindrical body about the axis A1 and having an outside diameter that is selected to allow the insulating body 98 to slide along the axis A1 at the center of the set of primary plates 94 of the first portion 50, for example, without making contact. This cylindrical insulating body 98, which may be tubular or solid, carries a series of secondary contact plates 102 projecting radially outwards from its cylindrical outside peripheral surface 100, thereby forming a corresponding number of distinct conductive elements of the second portion 52.

Each secondary plate 102 is thus anchored in the insulating body 100. Each secondary plate 102 extends radially outwards from an outside cylindrical surface of the cylindrical insulating body 98. Each secondary plate 102 is generally in the form of an angular sector of an annulus about the axis A1 and possesses an angular extent around the axis A1 that lies for example in the range 5° to 30°, and possibly in the range 10° to 20°, and a radial extent along the axis A1 from the outside cylindrical surface 100. In this embodiment, each of the secondary plates 102 presents a front face that is substantially plane and contained in a plane perpendicular to the axis A1.

In the example shown, each of the secondary plates 102 presents a rear face presenting two contact elements that are offset along the direction of the axis A1. In this example, the contact elements are constituted by two surface elements 104 and 106, each of which is substantially plane and contained in a respective plane perpendicular to the axis A1, the two planes of the two contact elements 104 and 106 being axially offset by an axial offset value D that is equal to the axial offset D between two adjacent primary plates 94 of the first series. Specifically, in an electrical contact relative position of the two portions, and possibly ignoring the end plates of the two series, a secondary plate 102 of the second portion is to come into contact simultaneously with two adjacent primary plates 94 of the first portion, and likewise a primary plate 94 of the first series is to come into contact simultaneously with two adjacent secondary plates 102 of the second portion. The surface elements 104 and 106 may be made of a conductive material that is different from the conductive material of a main body of the secondary plate, possibly a material that is better at withstanding electric arcs.

In analogous manner corresponding to the arrangement of the primary plates 94 of the first portion 50, the secondary plates 102 are arranged in a helix. Thus, two adjacent secondary plates 102 are angularly offset relative to each other by an angular gap S2 about the axis A1 and they are axially offset by an axial offset D along the direction of the axis A1. The angular extent of a plate in one of the series may be greater than the angular gap between two adjacent plates of the other series with which the plate is to come into contact.

In the example shown, each turn of the helix in which the secondary plates 102 are arranged comprises eight secondary plates that are mutually spaced apart and electrically insulated from each other on the insulating body 98. In this example, provision is made for the helix to have eight turns, giving sixty-four secondary plates 102.

Figure 14:
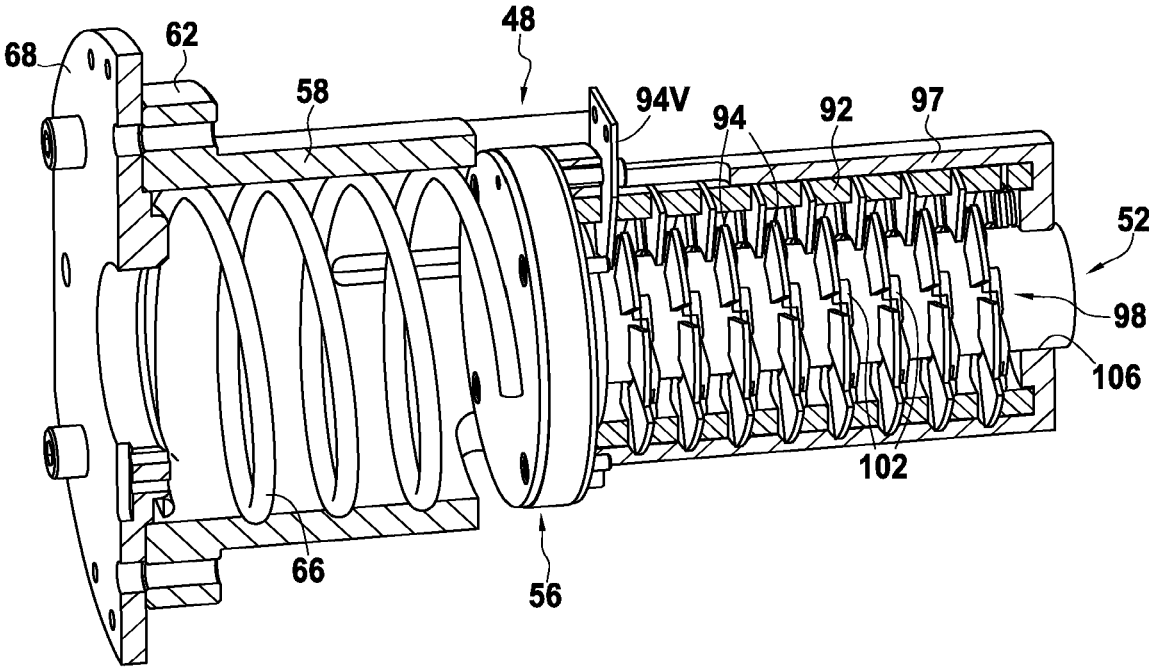
FIG. 14 is a perspective view, partially in section, showing the FIG. 11 splitter device when assembled.

As can be seen in FIG. 14, the second portion 52 is received coaxially inside the tubular body 92 of the first portion 50, and thus inside the outer envelope 97. At its rear end, the outer envelope presents an annular transverse wall that is pierced in its center by an orifice 106 to allow the rear end of the insulating cylindrical body 98 of the second portion to pass while sliding axially along the axis A1. As can be seen in FIG. 13, this rear end of the insulating cylindrical body 98 carries a contactor 39 that is to come into electrical contact with the contactor 38 of the connection member 24, as explained in the context of the first embodiment. By way of example, in this second embodiment, the contactor 39 may be electrically connected to a rear end secondary plate 102R of the series of secondary plates 102 of the second portion, which forms a rear end terminal for the splitter device 48.

With the splitter device 48 assembled in this way, for each of the portions 50, 52 of the splitter device, the distinct conductive elements 94, 102 in a given series are arranged on the insulating body carrying them in a helical configuration, and the two helices of the two portions share a common axis and are interleaved. For assembly purposes, provision may be made for the primary plates 94 to be plugged into the corresponding housings 95 in the insulating tubular body 92 of the first portion radially from the outside towards the inside after the first portion 50 carrying its secondary plates 102 has been engaged coaxially in the center of the insulating tubular body 92.

Figure 15:
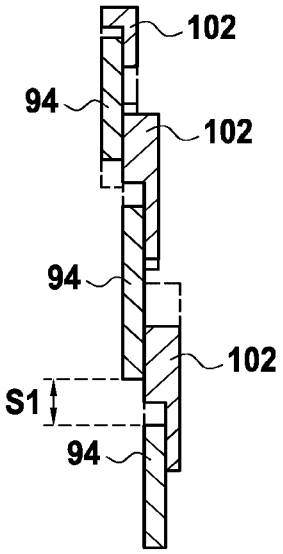
FIGS. 15 and 16 are diagrams showing the respective positions of distinct conductor elements of the two portions of the FIG. 11 device in developed views rolled-out flat.
Figure 16:
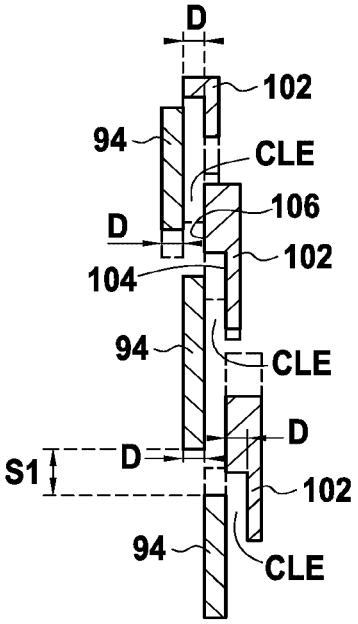

The two portions 50 and 52 of the splitter device 48 can slide relative to each other in a spacing movement between a contact position shown in FIG. 15 and a spaced-apart position shown in FIG. 16. In this example, the relative spacing movement between the two portions 50 and 52 is a movement in pure translation along the axis A1.

As in the first embodiment, a resilient return member, e.g. a spring between the two moving portions of the splitter device 48, is provided so that in the absence of contact with the moving connection member 24, the two portions occupy their spaced-apart relative positions. As can be seen more particularly in FIG. 16, in this spaced-apart position, all of the distinct conductive elements, specifically the primary plates 94 and the secondary plates 102, are spaced apart from one another in the axial direction of the spacing movement of the two portions, preventing any electrical connection through a solid material between these distinct conductive elements. Under the effect of the movement of the connection member 24, as described with reference to FIGS. 6 and 7 for the first embodiment, the two portions of the splitter device can be moved into a contact position in which each of the plates in one series is connected to two plates of the other series in order to create an electrical connection through the splitter device that is solid, in the sense of continuity between electrically connected-together solid conductors, and as shown in FIG. 15.

To ensure contact at each of the contacts that are provided, provision may be made for means to compensate geometrical dispersions, e.g. by providing that the plates in at least one of the two series are resilient, or by interposing resilient contact elements.

In similar manner to the first embodiment, the splitter device 48 in this second embodiment can be integrated within the cavity 31 of the first electrode, or indeed in another variant in a cavity in the connection member 24. Likewise, the breaker apparatus fitted with this second embodiment of a splitter device 48 can occupy the four states that are shown in FIGS. 4 to 7 for the first embodiment, depending on the position of the connection member 24.

In these first and second embodiments, in the electrical contact position between the two portions of the splitter device, the distinct conductive elements, specifically the two series, are electrically connected to the electric circuit and even form a portion of the electric circuit in that they are not only at the potential of that circuit, but in reality they also pass the nominal electric current, or in any event they are capable of passing this nominal electric current in the event that the apparatus includes a main continuous electrically-conductive path in the extreme closed position of the movable connection member, and a secondary continuous electrically-conductive path through the splitter device when the movable connection member has begun to move away from its extreme closed position.

Furthermore, it can be understood that in these embodiments, the electric arc splitter device comprises distinct conductive elements that, for at least one active state of the splitter device corresponding in both embodiments to the spaced-apart relative position of the two portions of the device, are spaced apart and electrically insulated from one another so as to define a multitude of successive distinct individual free paths in the surrounding insulating fluid, which paths may have electric arcs struck therein when the electric circuit is opened and/or closed. The distinct individual free paths are paths of reduced dielectric strength in the insulating fluid between two proximal distinct conductive elements belonging one to a series carried by one portion and the other to the other series carried by the other portion, along which paths electric arcs can be struck on opening and/or closing the electric circuit. It is along these individual free paths that there is a dielectric breakdown beyond a voltage difference threshold between the two proximal distinct conductive elements.

For these first and second embodiments of the disclosure, an individual free path in the spaced-apart position of the two portions of the device is provided between a distinct conductive element of one series carried by one of the portions and a distinct conductive element of the other series carried by the other one of the portions. In the first embodiment, such an individual free path CLE is provided between each contact 81 of a jumper 53 and the facing contact 82 of a branch 78 of a fork 76. In the second embodiment, such an individual free path is provided, in the spaced-apart position of the two portions of the device, between the rear face of a primary plate 94 and one of the two surface elements 104, 106 of a secondary plate 102 through the surrounding fluid.

In both embodiments, two successive distinct individual free paths are electrically connected together by one of the distinct conductive elements, and each individual free path is defined between two proximal distinct conductive elements. In the first and second embodiments, two proximal distinct conductive elements do not belong to the same series, with one of them being carried by one of the portions and the other being carried by the other portion of the device.

Furthermore, a distinct conductive element may connect together at most two distinct individual free paths.

In the first embodiment, provision may be made for insulating solid obstacles to limit the appearance of electric arcs between two adjacent distinct conductive elements in the same series, i.e. in particular between two contacts 81 of two adjacent jumpers 53 on the same bar 54, or between two contacts 82 belonging to two adjacent forks 76 in the same row. By way of example, these insulating obstacles are made in the form of insulating partitions 85 that extend rearwards from a rear face of a bar in order to define two recesses between them or to form two compartments within a single recess.

It can be understood that when the two portions of the splitter device are spaced apart, the splitter device is theoretically insulating between the upstream and downstream portions of the electric circuit that is to be broken. Nevertheless, this is only partially true insofar as, in the event of a very high potential difference existing between the upstream portion and the downstream portion, electric arcs can occur in the individual free paths that are created between the two portions of the splitter device, thus allowing current to flow through the splitter device, at least until the two portions are spaced apart by a certain amount.

In the splitter device of the disclosure, the distinct individual free paths are arranged successively in series along the preferred electrical path, thereby forming a corresponding number of relays in controlled positions for a series of electric arcs that might be struck.

It should be observed that at least some of these distinct individual free paths overlap with at least one other distinct individual free path in the direction of relative spacing movement between the two portions of the device. This makes it possible, in a given amount of space in the spacing direction between the two portions, to increase the number of arcs and/or to increase the total accumulated length of the distinct individual free paths, thereby ending up with an increased "arc length", and thus an increased total arc voltage within the device.

In the first and second embodiments, it may be observed that although the splitter device is independent of the movable connection member (they are not mechanically connected together other than via stationary parts of the apparatus), the relative spacing movement between the two parts 50 and 52 is controlled by the opening movement of the electrodes of the apparatus between their extreme open and closed positions, specifically by the opening movement of the movable connection member 24. In these two embodiments, one of the two relatively movable portions of the splitter device is carried by the other, and both portions are carried by only one of the two electrodes of the apparatus, specifically the stationary electrode 20.

The overall size of the second embodiment of the splitter device 48 is substantially identical to the overall size of the first embodiment, thereby enabling it to be installed in a manner that is identical to that described above, e.g. inside the cavity 31 of the first electrode 20. Nevertheless, it may be observed that the second embodiment of the disclosure, for given overall size, has a larger number of distinct individual free paths, specifically sixty-four. It may also be observed that the generally cylindrical shape of the second embodiment can make it easier to integrate in the arrangement that is generally used for such apparatuses.

FIGS. 17 to 21 show a third embodiment of the disclosure.

In the first two embodiments of the disclosure, the two relatively movable portions of the splitter device are carried one by the other, with one of the portions being secured to one of the electrodes of the breaker apparatus. The two relatively movable portions of the splitter device are thus distinct from the movable connection member that, under control from outside the enclosure of the apparatus, serves to cause the apparatus to open or close.

In the third embodiment of the disclosure, the splitter device has two portions 50 and 52, however in this embodiment, one of the portions is secured to one of the electrodes, typically the first electrode 20, while the second portion of the splitter device is secured to the movable connection member 24 that is carried by the other electrode.

Furthermore, unlike the first two embodiments in which each of the two relatively movable portions of the splitter device has a distinct series of distinct conductive elements, this third embodiment differs in that only one of the two relatively movable portions has a series of distinct conductive elements, while the other portion has one contactor. The series of distinct conductive elements may comprise a plurality of distinct conductive elements.

Figure 17:
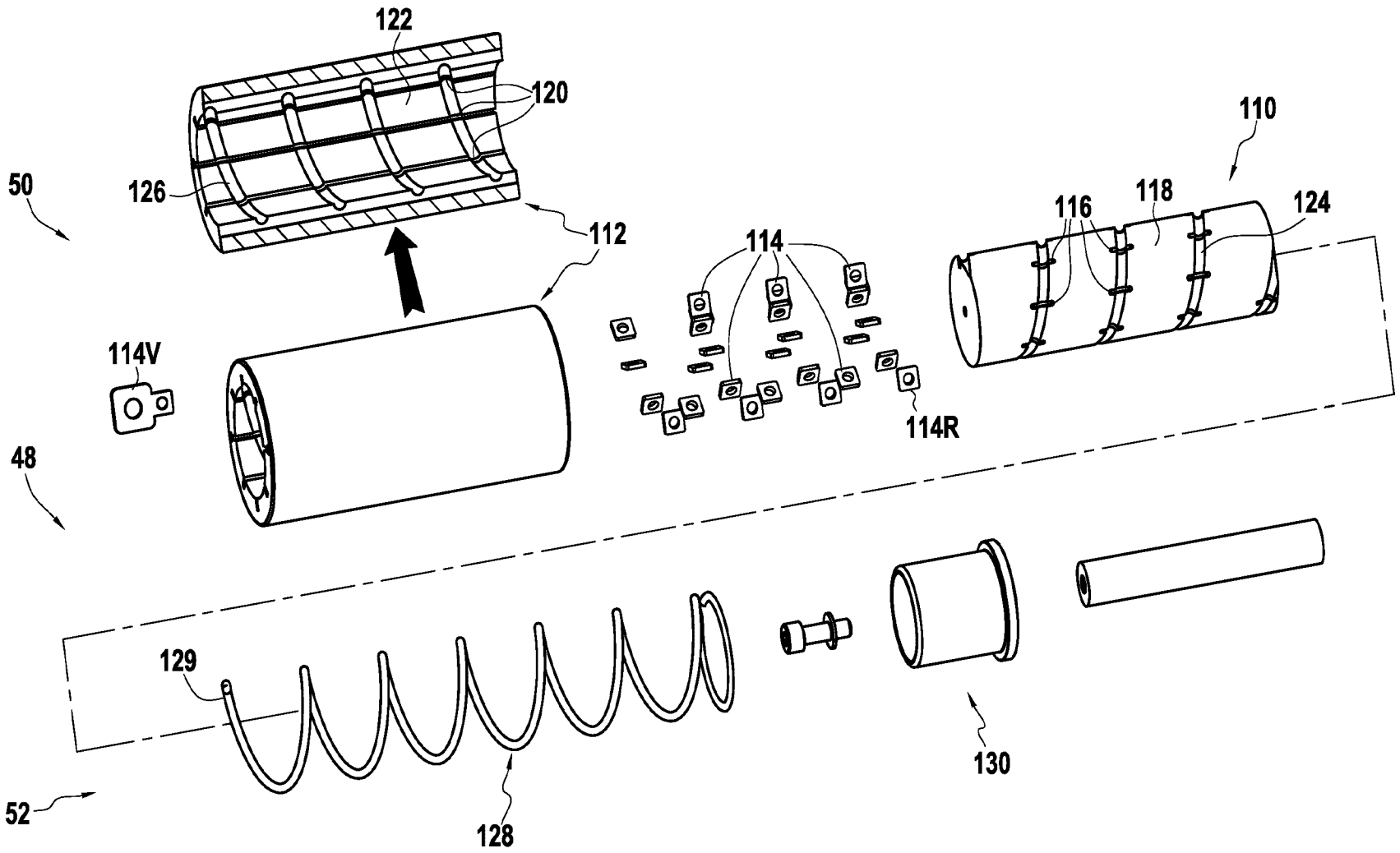
FIG. 17 is an exploded perspective view showing a third embodiment of a splitter device for an apparatus according to embodiments of the disclosure.

With reference to FIG. 17, it can be seen that the first portion 50 comprises at least a cylindrical insulating body that carries a series of distinct conductive elements laid out relative to one another on the insulating body along a layout curve. The distinct conductive elements are laid out in succession along this layout curve, for example, at regular intervals. This curve may be a rectilinear curve, i.e. a straight line, but it may be a curve that is not rectilinear, and that may be a non-rectilinear curve lying in a plane, but that may be a three-dimensional curve that cannot be inscribed in a plane. As explained below, this layout curve defines a preferred electrical path in an active state of the splitter device 48. In the example described below, the layout curve is a helical curve of constant pitch.

The spacing between two successive distinct conductive elements along the layout curve for the successive distinct conductive elements may be smaller than the spacing between any other conductive elements that are not in succession along the layout curve. This makes it possible in particular to avoid an electric arc appearing between two distinct conductive elements that are not successive. In particular, for a helical curve, the pitch of the helix may be greater than this spacing. Nevertheless, other configurations may be used in order to avoid such unwanted arcs between two distinct conductive elements that are not in succession along the layout curve.

In the example shown in FIGS. 17 to 21, the insulating body of the first portion 50 is made up of two parts: an inner cylindrical part 110 of axis A1, and an outer tubular cylindrical part 112 of axis A1. Nevertheless, it should be observed that the disclosure can be implemented using only one of these two parts. In this embodiment, the distinct conductive elements are made in the form of plates 114 made at least in part out of conductive material. In this example, these plates 114 are substantially square in shape and each has a circular hole at its center.

In this embodiment with a two-part body, provision is made for each essentially plane plate 114 to be received in part in a corresponding housing 116 formed in the outside cylindrical surface 118 of the inner cylindrical part 110, and in part in corresponding housings 120 arranged in an inside cylindrical surface 122 of the outer tubular cylindrical part 112. More precisely, in this example, the housings 116 in the inner cylindrical part 110 are individual housings for each plate 114. The plates 114 may be received in these housings 116 in the inner part 110 so as to be blocked in a desired orientation. In the example shown, this orientation corresponds to each plate being arranged in a radial plane containing the axis A1 so as to project radially outwards from the outside cylindrical surface 118 of the inner cylindrical part 110. A plurality of plates 114 may be contained in the same radial half-plane containing the axis A1 and bounded by the axis A1, being offset relative to one another axially along the axial direction A1 by a distance that is equal to the helical pitch of the layout curve. In the example shown, the housings 120 in the outer tubular cylindrical part 112 are made in the form of slots that are elongate in the axial direction A1 and that open out into the inside cylindrical surface 122 of the outer tubular cylindrical part 112. This configuration is favorable for assembly purposes since it is possible to place the plates 114 in their individual housings 116 in the inner part 110, and then cause that assembly to slide axially inside the outer tubular cylindrical part 112, with different aligned plates being received in a common slot 120. An inverse configuration could be used, with the individual housings arranged in the outer part 112 and slots arranged in the inner part 110. Likewise, the plates 114 could be fastened in only one of the inner or outer parts, without being received, not even in part, in a housing in the other one of the parts.

In an improvement, at least one of the two parts of the insulating body includes a groove that extends along the layout curve on which the plates 114 are arranged. The groove is for receiving a contactor 128 of the second portion 52 of the splitter device 48, at least in an electrical contact relative position of the two portions of the splitter device. Specifically, this groove is thus a helically-shaped elongate groove. In the example shown, each of the two parts of the insulating body is provided with a respective groove. An inner groove 124 is arranged in the outside cylindrical surface 118 of the inner part 110, and in section perpendicular to the helical layout curve of the plates it presents a section that is circularly arcuate, e.g. semicircular and radially open outwards in the outside cylindrical surface 118. An outer groove 126 is arranged in the inside cylindrical surface 122 of the outer part 112, and in section perpendicular to the helical layout curve of the plates 114 it presents a section that is circularly arcuate, e.g. semicircular, being radially open inwards in the inside cylindrical surface 122. When the inner and outer parts 110 and 112 of the insulating body are assembled together, the inner and outer grooves 124 and 126 are arranged facing each other along the helical layout curve of the plates so as to form a channel in the insulating body, which channel is of substantially circular section and extends along the layout curve of the plates 114. The plates 114 are mounted in the insulating body in such a manner that their central holes are concentric with the section of the channel formed by the inner and outer grooves 124 and 126 in the insulating body.

FIG. 17 also shows a front end plate 114V that is carried by the insulating body and that is to form a front end terminal that is electrically connected to one of the portions of the electric circuit that is to be broken, specifically the upstream portion connected to the first electrode 20.

The second portion 52 of the splitter device 48 essentially comprises a contactor 128 that is elongate along a layout curve identical to the layout curve of the plates 114 of the first portion 50. The contactor 128 is made so as to be conductive over its length and it is designed to be carried at its front end by the movable connection member 24 via a fastener interface 130. In the example shown, the fastener interface 130 is in the form of a cylindrical drum of axis A1 that is mounted on the movable connection member 24 so as to be capable of turning about the axis A1. The turning of the drum 130 about the axis A1 may be free or it may be controlled by the control mechanism 42. The contactor 128 is cantilevered out forwards from the drum 130 so as to extend forwards freely.

The contactor 128 is electrically connected to the other of the two portions of the electric circuit that is to be broken, specifically the downstream portion that is connected to the second electrode 22.

Movement of the movable connection member 24 to perform opening movement, in the opening direction or the closing direction for the electric circuit, and under the control of the control mechanism 42, thus corresponds in this embodiment to moving both portions 50 and 52 of the splitter device 48.

Figure 18:
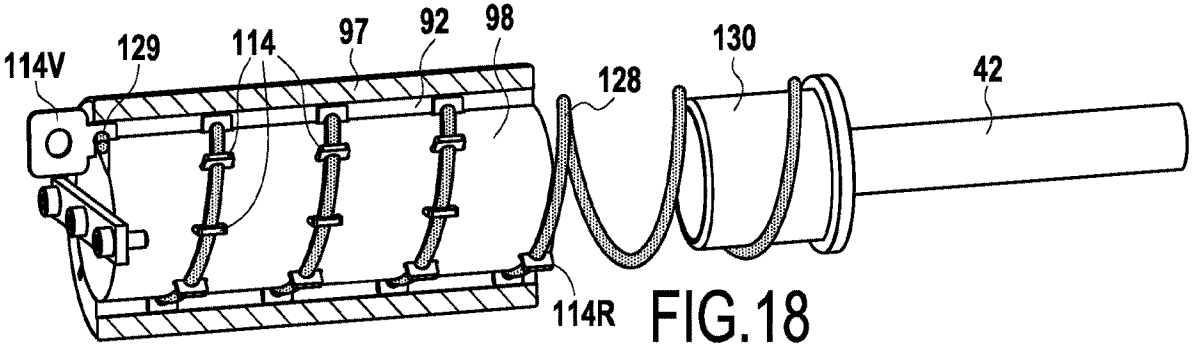
FIGS. 18 to 20 are partially cutaway perspective views respectively showing three distinct relative positions of the two portions of the FIG. 17 splitter device.
Figure 19:
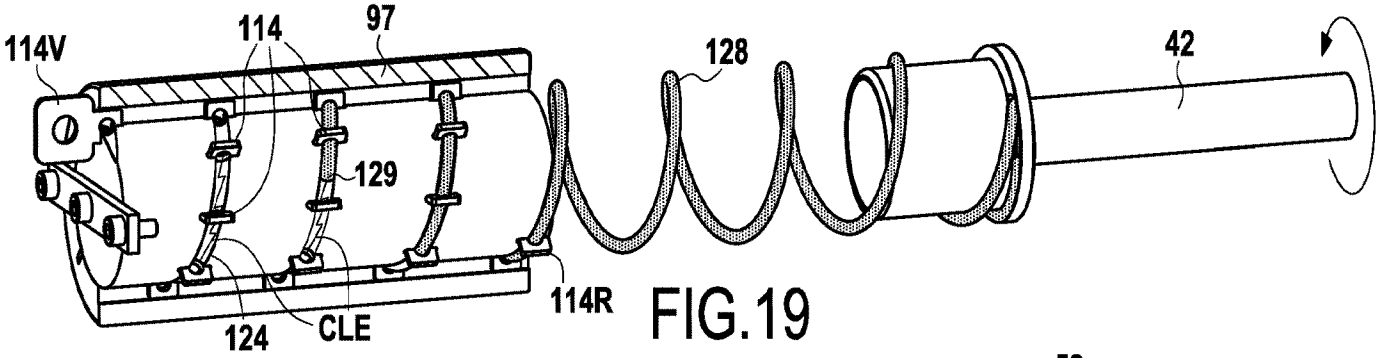
Figure 20:
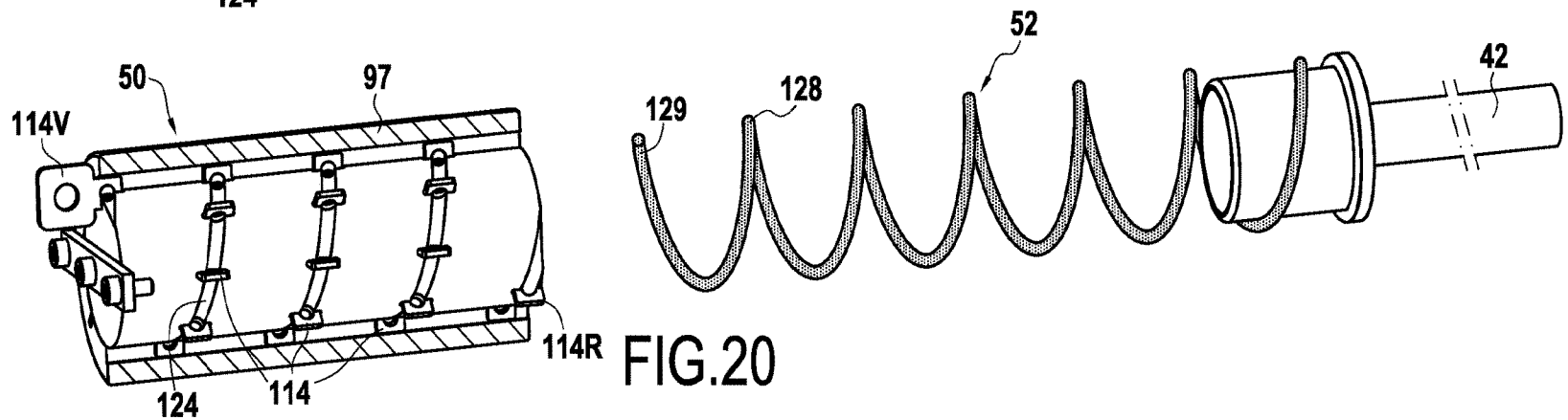

FIGS. 18, 19, and 20 show various configurations of this third embodiment of the splitter device 48 corresponding to different operating states. In these figures, the system is shown diagrammatically without showing the integration of the contactor 128 on the connection member 24.

FIG. 18 shows an electrical contact position between the two portions 50 and 52 of the splitter device 48. In this extended position, the contactor 128 is arranged so as to be received in the channel formed by the inner and outer helical grooves 124 and 126 of the insulating body. As a result, the contactor 128 is engaged in an interstitial space between the inner and outer parts 110 and 112 of the insulating body of the first portion. In this position, a free front end portion 129 of the contactor 128 is in electrical contact with the plates 114V forming the front end terminal. As a result, the downstream portion of the electric circuit, which is electrically connected in permanent manner to the contactor 128, is electrically connected by this electrical contact to the upstream portion of the electric circuit, thus allowing the nominal current to pass through the breaker apparatus, this nominal current flowing in the contactor 128. The two portions of the splitter device thus set up a continuous electrically-conductive path between the upstream portion and the downstream portion of the electric circuit, in particular along the contactor 128.

As for the first and second embodiments, provision may be made for the two portions of the splitter device when in the electrical contact relative position to make a secondary continuous electrically-conductive path that takes the place of a main continuous electrically-conductive path between the movable connection member 24 and the main body of the stationary electrode 20, with this happening as soon as direct contact between the movable connection member 24 and the main body of the stationary electrode 20 is lost at a pair of main contacts. To do this, provision may be made for an end-of-stroke absorber mechanism as described for the above embodiments. Nevertheless, such an end-of-stroke absorber mechanism is not shown in FIGS. 17 to 21.

As a result, in this position that is obtained for an electrical closure position of the electrodes of the mechanical apparatus, all of the distinct conductive elements that form part of the series carried by the relatively movable first portion of the splitter device are arranged along the continuous electrically-conductive path.

Furthermore, with the configurations of the plates 114 extending across the channel defined by the grooves 114, 116, the contactor 128 is also engaged through the central hole in each of the plates 114.

In a desirable manner, the contactor 128 is then in electrical contact with each of the plates 114 along the layout curve of the plates. The contactor 128 may be provided with an outer conductive surface over its entire length corresponding to the length of the layout curve for the plates 114.

FIG. 19 shows a relative position of the two portions of the splitter device 48 corresponding to an intermediate spaced-apart position. This position may correspond in particular to an intermediate position of the movable connection member. It can thus be seen that the contactor is retracted rewards relative to the position of FIG. 18. In this intermediate position, the contactor 128 is nevertheless still partially engaged in the channel defined along the layout curve of the plates 114 of the first portion, while nevertheless not extending over the entire length of the channel. Thus, the free end 129 of the contactor 128 is no longer in electrical contact with the end terminal 114V. As a result, the solid conductive path between the upstream portion and the downstream portion of the electric circuit that is to be broken is interrupted. Depending on the intermediate position, the contactor 128 is also disengaged and spaced apart from a certain number of plates among the first plates 114 in their successive order from the front towards the rear along the layout curve of the plates. In this position, each of the plates of this group of plates 114 from which the contactor is disengaged is thus spaced apart from and electrically insulated relative to the other plates 114 and the contactor 128 (in the absence of any electric arc). In contrast, the contactor 128 remains engaged with the remaining plates, i.e. with the group of successive plates that are arranged behind the front free end 129 of the contactor along the layout curve of the plates, for the position under consideration of the contactor 128 relative to the insulating body 110, 112.

The spacing movement of the contactor 128 relative to the plates 114 carried by the insulating body of the first portion 50 is movement in which the contactor 128 moves along the layout curve of the plates 114 over the insulating body. In the example shown, this movement is thus helical movement combining both movement in translation along the axis A1 and movement in rotation about the axis A1, the two movements being proportional as determined by the pitch of the helix formed by the layout curve of the plates. The contactor extends along the same helix. In an embodiment in which the plates are arranged by way of example along a circularly arcuate curve contained in a plane, the contactor would be in the form of a circular arc having the same radius and the same center, and the movement would be relative movement in rotation about the center of the arc of a circle that is common both to the layout curve of the plates and to the contactor.

In the position of FIG. 19, all of the plates 114 situated in front of the front free end 129 of the contactor 128 are disengaged from the contactor. The portion of the channel along the layout curve of the plates that is situated between the front free end 129 of the contactor 128 and the front end terminal 114 is released from the contactor. Over this portion, there is thus a certain number of plates 114, referred to as the "front group" of plates, that are separated by distinct individual free paths CLE that follow one another in series along the layout curve of the plates.

In this intermediate spaced-apart position, the splitter device 48 defines a preferred electrical path between the upstream portion and the downstream portion of the electric circuit, which path comprises, between the front main terminal 114V and the front end of the contactor 128, an alternation of conductive sections comprising the distinct conductive elements, specifically the distinct conductive elements of the front group of plates, all carried by the same relatively movable portion of the plate device, and insulating portions (in the absence of electric arcs) comprising the successive distinct individual free paths defined between successive pairs of plates 114 of the front group. In this embodiment, the individual free paths are created between distinct conductive elements 114 belonging to the same series, and carried by the same relatively movable portions 50 of the splitter device 48.

FIG. 20 shows an extreme spaced-apart position for the two portions of the splitter device in which the contactor 128 is fully disengaged from the insulating body 110, 112 carrying the plates 114. The front free end 129 of the contactor 128 is thus arranged at a distance from the rear end plate 114R of the series of plates of the splitter device, and is consequently spaced apart from the plates carried by the first portion of the splitter device.

In this extreme spaced-apart position, the splitter device 48 defines a preferred electrical path between the upstream portion and the downstream portion of the electric circuit, which path comprises in alternation conductive sections comprising the distinct conductive elements, in this example all of the distinct conductive elements, all carried by the same relatively movable portion of the plate device, and insulating sections comprising the successive distinct individual free paths defined between the successive plates 114 in pairs. The preferred electrical path also includes an insulating section between the rear end plate 114R and the front free end 129 of the contactor 128.

In the extreme spaced-apart position, corresponding in this configuration to a maximum value of the spacing between the front free end 129 of the contactor 128 and the rear end plate 114R, this spacing is determined as a function of the dielectric strength that it is desired to obtain for the apparatus 10 in the open position of the electric circuit.

In the example shown, the contactor 128 has a conductive main portion that extends along a layout curve identical to the layout curve of the plates and that presents a section that is constant in planes perpendicular to the layout curve. The main portion presents a length along the layout curve that is not less than the distance along the layout curve between the front end terminal 114V and the rear end plate 114R of the series of plates of the splitter device.

It can thus be understood that in this third embodiment the preferred electrical path follows the layout curve of the plates 114 over the insulating body of the first portion of the device. Consequently, it can be understood that the contactor 128 presents a shape that is elongate along the path of the preferred electric circuit defined by the layout curve of the plates.

In this example, it can be understood that the preferred electrical path coincides with the path of at least one of the two portions of the splitter device performing its relative spacing movement, e.g. specifically to the path of a point of the contactor 128 relative to the insulating body 110, 112. As a result, at least some of the distinct individual free paths extend along a path that presents a non-zero component in projection onto a direction perpendicular to the opening movement path of the movable connection member, and they can thus present a total length that is greater than the length that they occupy along the direction of the axis A1. It is thus possible to have a total "arc length" that is greater, and/or to increase the number of electric arcs between two successive conductive elements.

More particularly, and as described above, when a channel is formed in the insulating body, and the insulating body is made of an insulating material that possesses ablation properties enabling pressure to rise locally and presenting greater dielectric strength than the surrounding fluid present in the enclosure of the apparatus, the channel tends to be even better at directing and cooling any electric arc that might propagate from plate to plate, each electric arc extending between two successive plates and each plate then forming a relay between two successive arcs. Such a channel makes it possible in particular to avoid an electric arc appearing between two distinct conductive elements 114 that are not in succession along the layout curve. It thus makes it possible potentially to reduce the pitch of the helix when the layout curve is helical. This effect is even stronger when the outside diameter of the outside surface 118 of the inner portion 110 is close to the inside diameter of the inside cylindrical surface 122 of the outer portion 112 of the insulating body. The effect is maximized if these two diameters are equal, in which case the channel presents a section that is closed by virtue of the contact between the outside surface 118 of the inner portion 110 and the inside surface 122 of the outer portion 112.

It should be observed at this point that the path followed by the contactor 128 is a helical path, at least so long as the contactor 128 is not fully disengaged from the series of distinct conductive elements 114. In contrast, the path of the movable connection member is, overall, a movement in translation along the axis A1.

It may be observed that the fact that the contactor 128 is engaged in the holes in the plates 114 represents an embodiment associated with the arrangement of the plates across the passage of the contactor 128 along the insulating body. Nevertheless, it is also possible to envisage that the plates are arranged not across the passage followed by the contactor 128 along the insulating body, but in the immediate proximity of that passage, without any electrical contact between the plate(s) and the contactor 128, e.g. at a distance of less than 10 mm, possibly less than 5 mm, and even less than 2 mm. This proximity is selected so that when the end 129 of the contactor 128 passes close to a given plate, any electric arc between that end and a preceding plate along the curve becomes attached to said given plate. This ensures that the successive arcs are attached from plate to plate along the layout curve between the front end plate and the front end 129 of the contactor 128 until the arcs become completely extinguished when the accumulated length is long enough.

Figure 21:
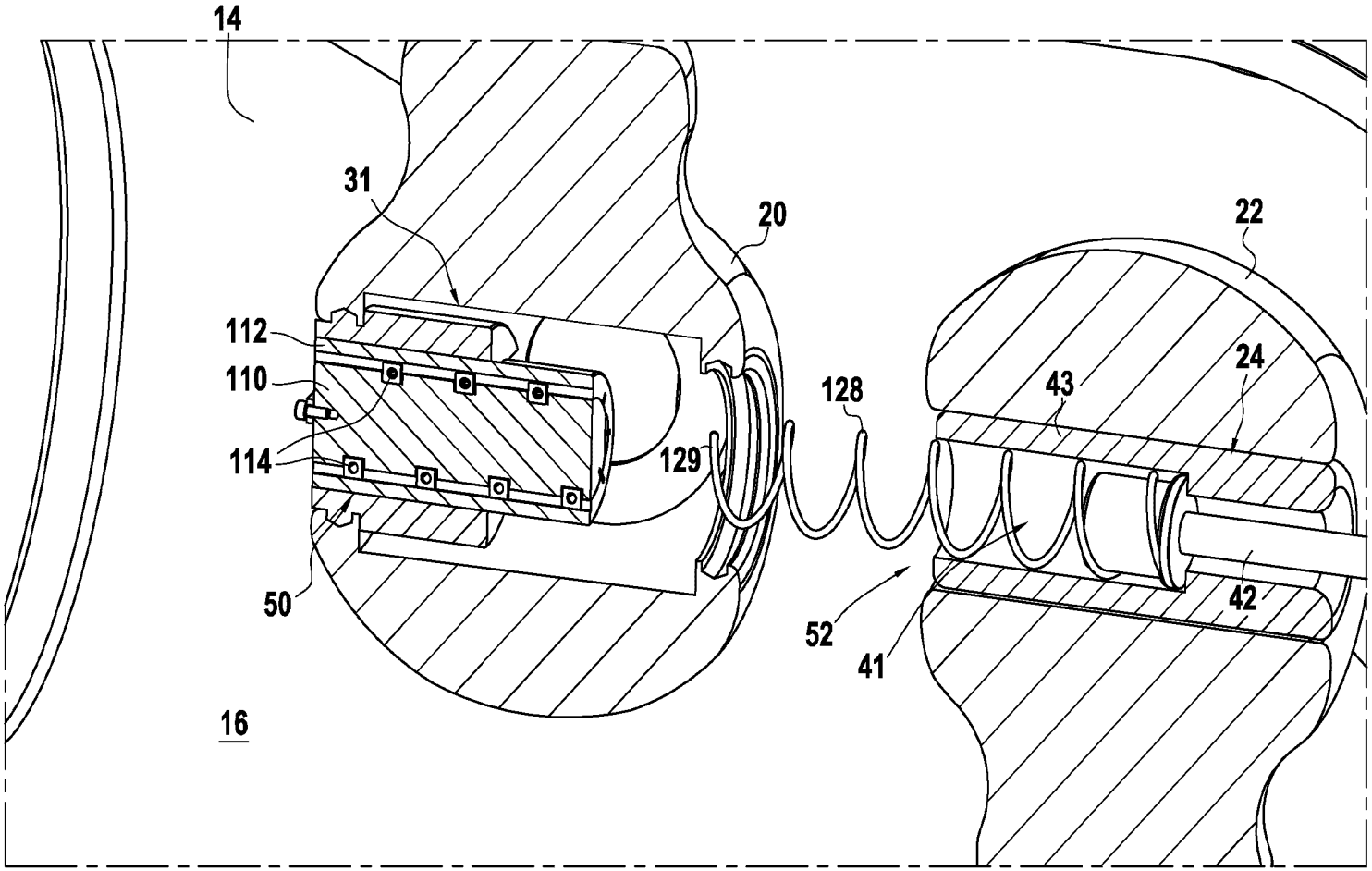
FIG. 21 is a partially cutaway diagrammatic perspective view showing a FIG. 17 splitter device installed in a breaker apparatus.

FIG. 21 shows a possible arrangement for such a splitter device in a breaker apparatus of the type described with reference to FIGS. 1 and 2. This figure shows that the first portion 50 of the splitter device 48 may be housed inside the internal cavity 31 in the first electrode 20. The second portion 52 of the splitter device 48 may then be housed at least in part inside an internal cavity 41 in the connection member 24. The connection member 24 may present, at least in its front portion, a tubular bushing 43 of axis A1 that may be made of conductive material, within which the cavity 41 is provided so as to be forwardly open towards the first electrode 20. In the embodiment shown, provision (not shown) may be made for the contactor 128, and optionally its drum 130, to be axially movable relative to the tubular bushing 43 of the movable connection member 24, e.g. by making provision for the contactor 128 to move relative to the bushing 43, or indeed by making provision for the bushing 43 to be telescopic. Such a provision makes it possible to ensure that in an extreme open position of the movable connection member, when fully retracted rearwards, the movable contactor 128 is received as much as possible inside the cavity 41. In contrast, when the movable connection member is caused to move towards its closed position, the bushing 43 may be brought into contact axially forwards with a bearing surface of the first electrode 20 or of the first portion 50 of the splitter device, starting from an intermediate position of the movable connection member 24, with it also being possible for the movable contactor 128 to continue its movement towards the relative contact position shown in FIG. 18.

In a variant it is possible to make provision for the first portion of the splitter device 48, comprising the insulating body 110, 112 carrying the plates 114, to be mounted so as to movable in rotation about the axis A1 in the breaker apparatus, with the contactor 128 of the second portion then potentially being stationary in rotation about the axis A1.

In a variant, the first portion 50 of the device 48 comprising the insulating body carrying the plates 114 could be selected to be movable axially in the apparatus, e.g. by being carried by the movable connection member 24, with the contactor 128 then being stationary, it being possible for it then to be mounted in stationary manner in the apparatus, e.g. in the internal cavity 31 in the first electrode 20.

This third embodiment does not have an end-of-stroke absorber device for the stroke of the movable connection member. Nevertheless, such a device could be provided by using the same concept as described with reference to the first and second embodiment.

Each of the above-described splitter devices defines a desired electrical path when it is not in its contacting position, and electric current can flow along the desired electrical path in the event of dielectric breakdown resulting from a large difference in electric potential exceeding the dielectric strength between the two portions of the device. Along this desired electrical path, electric current flows either by being conducted in distinct conductive elements that are solid, or else in the form of electric arcs in the individual free path(s). The desired electrical path may be considered as a path of least dielectric strength between the upstream portion and the downstream portion of the electric circuit for the spaced-apart position(s) of the portions of the splitter device.

In the above examples, it is also possible to implement the disclosure in a breaker apparatus in which there is no direct contact between the movable connection member and the stationary electrode in the electrically closed position of the electrodes of the mechanical apparatus, with electrical contact then being established only via the splitter device. Under such circumstances, the nominal electric current flows through the apparatus along the continuous electrically-conductive path defined by the two portions of the splitter device in the contacting position, which would then constitute a main continuous electrically-conductive path along which said distinct conductive elements are arranged.

In the embodiments, it can be seen that the main or secondary continuous electrically-conductive path is formed by the object(s) made of solid and conductive materials through which the nominal electric current flows when the two members of the apparatus are in the electrically closed position and/or the two portions of the splitter device are in the electrical contact position. Insofar as the continuous electrically-conductive path has a plurality of solid and conductive physical objects, these objects are electrically in contact with one another. The continuous electrically-conductive path thus has a physical aspect, that of the solid and conductive physical object making it up, and a geometrical aspect, that of the shapes of those objects.

In the embodiments, the distinct conductive elements extend over only a portion of the continuous electrically-conductive path in the apparatus. The remainder of the continuous electrically-conductive path includes in particular the electrodes, the connection terminals, and the movable connection member.

In the meaning of the disclosure, the distinct conductive elements are arranged along the main or secondary continuous electrically-conductive paths, in the sense that for at least certain states of the apparatus in which the two portions of the splitter device are in an electrically contacting relative position, the distinct conductive elements:

form portions of solid and conductive physical objects in which the continuous electrically-conductive current flows, as in the first and second embodiments; and/or as in the third embodiment, they are arranged in the immediate proximity of, for example, in mechanical contact with, or even in electrical contact with one or more solid and conductive physical objects through which the nominal electric current flows. For example, in the operating conditions when opening the apparatus, it is considered that proximity is immediate when the end of the contactor 128 going past the plate 114 causes the electric arc to become attached thereto.

In the embodiments, the continuous electrically-conductive path, at least for the portion along which the distinct conductive elements are arranged, is a path that is single, in the sense that it does not have any parallel branches, at least in this portion.

In the embodiments, the distinct individual free paths correspond to geometrical paths along which there are no solid and conductive physical objects, but only insulating fluid.

It can thus be considered that in the electrical contact relative position between the two portions of the splitter device, the distinct individual free paths are of zero length.

In the embodiments, each of the distinct individual free paths is created during the opening movement of the two members of the apparatus, in the sense that the length of the individual free paths varies during the opening movement by going from a zero value to a value where a total arc voltage built up throughout the splitter device 48 can reach a value such as to cause the electric arc to disappear. In an active state of the splitter device 48, the total dielectric strength of the individual free paths in the absence of any arc may become significant, for example greater than 1 kV/mm.

Each of the distinct individual free paths may be created progressively during the opening movement of the two members of the apparatus. This progressive creation of distinct individual free paths starting from a zero value, as made possible by the arrangement of the distinct conductive elements along the continuous electrically-conductive path in which the nominal current flows immediately prior to the loss of contact between the two portions of the splitter device, makes it possible to control where arcs are created and does not require action by a system for moving an arc towards a remote chamber as in the prior art.

In the embodiments in which the splitter device has a first portion 50 and a second portion 52 that are movable relative to each other, each of the distinct individual free paths is created more particularly by the movement spacing the two portions of the device apart.

The distinct individual free paths, or at least some of them, may be created successively one after another over time, in particular with a time offset associated with the opening movement of the two electrodes of the apparatus, or with the movement spacing the two portions of the splitter device apart when the device has a first portion and a second portion that are movable relative to each other. This applies in the third embodiment where the distinct individual free paths are created in succession one after another as the contactor moves rearwards during the movement spacing the contactor away from the first portion 50 of the splitter device.

The distinct individual free paths, or at least some of them, may be created simultaneously, as in the circumstances illustrated by the above-described first and second embodiments.

In the embodiments, for a spaced-apart position, the sum of the lengths of the distinct individual free paths of the desired electrical path is greater than the length of the movement for spacing apart the two relatively movable portions of the splitter device between their contact position and their spaced-apart position. This increase in the "arc length", and the possibility of also increasing the number of arcs by increasing the number of individual free paths between two proximal distinct conductive elements makes it possible to increase the capacity of the splitter device, and thus of the breaker apparatus, to extinguish an electric arc created during opening by opposing a large arcing voltage immediately or almost immediately, as in the first and second embodiments, or progressively, as in the third embodiment. These two advantages may be obtained for given compactness of the apparatus, in particular compactness along the travel direction of the movable connection member.

In the embodiments described, it can be understood that the splitter device, at least in an opening position prior to an extreme opening position, creates a multitude of distinct individual paths between a multitude of distinct conductive elements that are electrically insulated from one another. The apparatus of the disclosure may have at least five distinct individual paths, possibly at least ten distinct individual paths, or even at least thirty distinct individual paths.

The disclosure is not limited to the examples described and shown since various modifications may be applied thereto without going beyond its ambit.

From the above description, it can be seen clearly that regardless of the embodiment of the splitter device, there may be advantage in arranging the splitter device inside an internal cavity arranged in the first electrode or in the second electrode.

Therefore, it may be advantageous to have a mechanical breaker apparatus for a high voltage or very high voltage electric circuit, the apparatus being of the type comprising two electrodes 20, 22, 24 that are to be connected electrically respectively to an upstream portion and to a downstream portion of the electric circuit, the two electrodes of the mechanical apparatus being movable relative to each other in an opening movement between at least one electrically open position and at least one electrically closed position in which they make a nominal electrical connection of the apparatus 10, said nominal electric connection serving to pass a nominal electric current through the apparatus, and of the type including an electric arc splitter device 48 having a multitude of distinct conductive elements that, for at least one active state of the splitter device, are spaced apart and electrically insulated from one another so as to define, in a surrounding insulating fluid, a multitude of successive distinct individual free paths in which electric arcs can be struck on opening and/or closing the electric circuit, and of the type comprising a sealed enclosure containing an insulating fluid and in which there are arranged at least the first electrode 20 and the second electrode 22, said apparatus being characterized in that at least some of the distinct conductive elements of the splitter device 48 are housed in an internal cavity arranged in the first electrode or the second electrode.

In such an apparatus, the splitter device may be designed as described in the above examples, which may have the advantage of being very compact, thereby facilitating housing them in an internal cavity of relatively small dimensions, but other designs are also possible.

In such an apparatus, the internal cavity may be arranged inside an envelope defined by a conductive peripheral surface of the first electrode. In a variant, at least the second electrode includes a movable connection member 24 that is movable in an opening movement relative to the first electrode between an extreme electrically open position and an extreme electrically closed position in which it establishes a nominal electrical connection with the first electrode 20, and the internal cavity is arranged inside an envelope defined by a conductive insulating peripheral surface of the movable connection member 24.

The invention claimed is:

1. A mechanical breaker apparatus for a high voltage or very high voltage electric circuit, the apparatus comprising:

two electrodes including a first electrode and a second electrode configured to be connected electrically respectively to an upstream portion and to a downstream portion of the electric circuit, the two electrodes of the mechanical apparatus being movable relative to each other in an opening movement between at least one electrically open position and at least one electrically closed position in which the two electrodes make a nominal electrical connection of the apparatus, said nominal electric connection serving to pass a nominal electric current through the apparatus;

an electric arc splitter device having a multitude of distinct conductive elements that, for at least one active state of the splitter device, are spaced apart and electrically insulated from one another so as to define, in a surrounding insulating fluid, a multitude of successive distinct individual free paths in which electric arcs can be struck on opening and/or closing the electric circuit; and a sealed enclosure containing an insulating fluid in which the two electrodes are arranged, wherein at least some of the distinct conductive elements of the splitter device are housed in an internal cavity arranged in the first electrode or the second electrode.

2. The mechanical breaker apparatus according to claim 1, wherein the internal cavity is arranged inside an envelope defined by a conductive peripheral surface of the electrode in which it is arranged.

3. The mechanical breaker apparatus according to claim 1, wherein:

at least the second electrode includes a movable connection member that is movable in an opening movement relative to the first electrode between an extreme electrically open position and an extreme electrically closed position in which the movable connection member establishes a nominal electrical connection with the first electrode; and the internal cavity is arranged inside an envelope defined by a conductive insulating peripheral surface of the movable connection member.

4. The mechanical breaker apparatus according to claim 1, wherein a pressure of the insulating fluid inside the sealed enclosure is greater than 3 bars absolute.

5. The mechanical breaker apparatus according to claim 1, wherein the splitter device comprises two portions that are relatively moveable, the two portions including a first portion and a second portion, at least one of which is movable relative to the other with a relative spacing movement between:

at least one electrical contact position of the two portions defining a continuous electrically-conductive path for the nominal electric current through the apparatus; and at least one spaced-apart position of the two portions.

6. The mechanical breaker apparatus according to claim 5, wherein at least one of the portions of the splitter device is carried by one electrode, and wherein the relative spacing movement of the two portions is controlled by the opening movement of the electrodes between an extreme open position and a closed position.

7. The mechanical breaker apparatus according to claim 5, wherein, for said spaced-apart position of its the two portions, the splitter device defines a preferred electrical path between the upstream portion and the downstream portion of the electric circuit, which preferred electrical path comprises in alternation conductive sections comprising the distinct conductive elements, and insulating sections comprising the successive distinct individual free paths.

8. The mechanical breaker apparatus according to claim 7, wherein, for said spaced-apart position, a sum of lengths of the distinct individual free paths of the preferred electrical path is greater than a length of a spacing movement of the two portions between the contact position and said spaced-apart position.

9. The mechanical breaker apparatus according to claim 5, wherein, in the electrical contact position, the two portions of the splitter device are in electrical contact via a multitude of distinct electrical contacts, each of which involves at least one of the distinct conductive elements.

10. The mechanical breaker apparatus according to claim 9, wherein one of the two relatively movable portions of the splitter device includes an elongate contactor, the contactor being electrically connected, at least during a stage of breaking the contact, with one of the portions of the electric circuit, and the other of the two relatively movable portions of the splitter device includes an insulating body having arranged thereon said series of distinct conductive elements, and wherein the contactor and the series of distinct conductive elements are arranged respectively in such a manner that in the electric contact position of the two portions, the distinct conductive elements are arranged on the insulating body in succession along the elongate contactor.

11. The mechanical breaker apparatus according to claim 10, wherein, in an extreme spaced-apart position, the contactor is spaced apart from the distinct conductive elements.

12. The mechanical breaker apparatus according to claim 10, wherein the contactor is elongate along a helical curve.

13. The mechanical breaker apparatus according to claim 5, wherein each of the two relatively movable portions of the splitter device includes an insulating body having arranged thereon a series of distinct conductive elements that are electrically insulated from one another, and wherein each of the two series of distinct conductive elements are arranged respectively in such a manner that:

in an electrical contact relative position of the two relatively moveable portions, each distinct conductive element of the two series, with an exception of end elements, is electrically in contact with two successive distinct conductive elements of the other series; and in a spaced-apart relative position of the two portions distinct from the electrical contact relative position of the two portions, each distinct conductive element of the two series is spaced apart from the distinct conductive elements of the other series.

14. The mechanical breaker apparatus according to claim 13, wherein a relative spacing movement of the two portions of the splitter device causes the electrical contact between all of the distinct conductive elements of the two series to be made simultaneously or broken simultaneously.

15. The mechanical breaker apparatus according to claim 13, wherein, in the spaced-apart position, distinct individual free paths are created firstly between a distinct conductive element of a first series and a proximal distinct conductive element of the other series, and secondly between said proximal distinct conductive element of the other series and another distinct conductive element of the first series.

16. The mechanical breaker apparatus according to claim 13, wherein, for each of the relatively moveable portions of the splitter device, the distinct conductive elements of a given series are arranged on the insulating body in a helical arrangement, and wherein the two helices of the two relatively moveable portions are coaxial and interleaved.

17. The mechanical breaker apparatus according to claim 13, wherein for each of the relatively moveable portions of the splitter device, the distinct conductive elements of a given series are arranged on the insulating body in a plurality of parallel rows, and wherein the rows of the two portions are parallel and interleaved.

18. The mechanical breaker apparatus according to claim 1, wherein each of the two electrodes are electrically connected permanently to an associated connection terminal, regardless of whether the electrodes are in the open position or in the closed position.

19. The mechanical breaker apparatus according to claim 5, wherein the splitter device includes at least one series of distinct conductive elements that are arranged along a continuous electrically-conductive path as defined by the two portions of the splitter device in the electrical contact position for passing the nominal electric current through the apparatus.

20. The mechanical breaker apparatus according to claim 19, wherein, in the electrically closed position of the electrodes of the mechanical apparatus, the nominal electric current flows along a main continuous electrically-conductive path, and wherein the continuous electrically-conductive path for the nominal electric current defined by the two portions of the splitter device in the electrical contact position constitutes a secondary continuous electrically-conductive path through the apparatus, along which said distinct conductive elements are arranged.

21. The mechanical breaker apparatus according to claim 19, wherein, in the electrically closed position of the electrodes of the mechanical apparatus, the nominal electric current flows along the continuous electrically-conductive path for the nominal electric current defined by the two portions of the splitter device in the electrical contact position, which constitutes a main continuous electrically-conductive path through the apparatus along which said distinct conductive elements are arranged.

22. The mechanical breaker apparatus according to claim 19, wherein at least one of the portions of the splitter device includes said series of distinct conductive elements arranged along the continuous electrically-conductive path.

23. The mechanical breaker apparatus according to claim 1, wherein:

the two electrodes comprise a first electrode and a second electrode;

the first electrode is stationary and the second electrode includes a movable connection member, a first portion of the splitter device is carried by the first electrode;

a second portion of the splitter device is carried by the first portion of the splitter device or by the first electrode, with a possibility of relative spacing movement between an electrical contact position and a spaced-apart position;

the movable connection member is in contact with the second portion of the splitter device between a closed position of the movable connection member and an intermediate position of the movable connection member corresponding to the spaced-apart position of the two portions of the splitter device; and the movable connection member is spaced apart from the second portion of the splitter device between the intermediate position and an extreme open position.

24. The mechanical breaker apparatus according to claim 23, wherein, between the closed position and an intermediate position of the movable connection member, at least one distinct conductive element of the splitter device is electrically connected to the movable connection member by the movable connection member making contact with the second portion of the splitter device.

25. The mechanical breaker apparatus according to claim 23, wherein, in the electrical contact position of the two portions of the splitter device, a nominal load current through the mechanical breaker apparatus passes via electrical contact between the movable connection member and the second portion of the splitter device.

* * * * *